US011739589B1

(12) United States Patent
Kaiser et al.

(10) Patent No.: US 11,739,589 B1
(45) Date of Patent: Aug. 29, 2023

(54) GATE ASSEMBLY AND KIT

(71) Applicant: Kidco, Inc., Vernon Hills, IL (US)

(72) Inventors: Daniel Kaiser, Cape Coral, FL (US); Kenneth Kaiser, Cape Coral, FL (US)

(73) Assignee: KIDCO, INC., Vernon Hills, IL (US)

( * ) Notice: Subject to any disclaimer, the term of this patent is extended or adjusted under 35 U.S.C. 154(b) by 0 days.

(21) Appl. No.: 17/730,898

(22) Filed: Apr. 27, 2022

(51) Int. Cl.
*E06B 9/04* (2006.01)
*E06B 9/00* (2006.01)

(52) U.S. Cl.
CPC ..... *E06B 9/04* (2013.01); *E06B 2009/002* (2013.01)

(58) Field of Classification Search
CPC .... E06B 2009/002; E06B 9/04; E06B 11/022; E06B 11/02; E06B 7/32
See application file for complete search history.

(56) References Cited

U.S. PATENT DOCUMENTS

| | | | | |
|---|---|---|---|---|
| 5,134,806 | A | 8/1992 | Burkart, Jr. | |
| 5,797,218 | A * | 8/1998 | Holland | E06B 9/04 49/55 |
| 7,975,431 | B2 | 7/2011 | Flannery | |
| 8,615,931 | B2 | 12/2013 | Dunn | |
| 8,627,602 | B2 | 4/2014 | Yates | |
| 8,875,444 | B2 | 11/2014 | Dunn | |
| 9,366,075 | B2 | 6/2016 | Marsden et al. | |
| 9,874,055 | B1 | 1/2018 | Flannery | |
| 10,006,243 | B1 | 6/2018 | Flannery et al. | |
| 10,081,980 | B2 * | 9/2018 | Birkert | E06B 9/04 |
| 10,107,030 | B2 | 10/2018 | Raffi et al. | |
| 10,221,618 | B2 | 3/2019 | Pedersen et al. | |
| 10,450,795 | B2 | 10/2019 | Raffi et al. | |
| 10,533,370 | B1 | 1/2020 | Flannery et al. | |
| 10,619,807 | B1 | 4/2020 | Flannery et al. | |
| 10,774,587 | B2 | 9/2020 | Flannery et al. | |
| 10,907,382 | B2 | 2/2021 | Raffi et al. | |

(Continued)

FOREIGN PATENT DOCUMENTS

| | | |
|---|---|---|
| CN | 202300117 U | 7/2012 |
| CN | 205677504 U | 11/2016 |

(Continued)

OTHER PUBLICATIONS

International Search Report and Written Opinion issued in corresponding PCT Application No. PCT/US2022/026546, dated Dec. 15, 2022.

*Primary Examiner* — Justin B Rephann
(74) *Attorney, Agent, or Firm* — Quarles & Brady, LLP

(57) ABSTRACT

A gate assembly that comprises a support assembly and a gate. The support assembly comprises a first support, a second support, and a base positioned between the first support and the second support. The base comprises a first flange adjacent a first end of the base and a second flange adjacent a second end of the base. The first flange is positioned within the first support and the second flange is positioned within the second support. The gate comprises an upper rail, a lower rail, and a plurality of posts disposed orthogonally with respect to the upper rail and the lower rail. The plurality of posts are removably engaged with the upper rail and the lower rail. The gate is rotatably attached to the support assembly. The first flange is removably attached to the first support and the second flange is removably attached to the second support.

20 Claims, 13 Drawing Sheets

(56) References Cited

U.S. PATENT DOCUMENTS

| | | | | |
|---|---|---|---|---|
| 10,934,768 | B2 | 3/2021 | Flannery et al. | |
| 10,934,769 | B2 | 3/2021 | Flannery et al. | |
| 11,015,386 | B2 | 5/2021 | Wang | |
| 11,035,173 | B1 | 6/2021 | Flannery et al. | |
| 11,041,340 | B1 | 6/2021 | Flannery et al. | |
| 11,054,096 | B1 | 6/2021 | Flannery et al. | |
| 11,111,719 | B1 | 9/2021 | Flannery et al. | |
| 11,118,398 | B2 | 9/2021 | Kaiser et al. | |
| 2002/0157316 | A1* | 10/2002 | Andersen | E06B 9/04 49/55 |
| 2008/0185566 | A1 | 8/2008 | Flannery | |
| 2012/0324792 | A1 | 12/2012 | Bertsch et al. | |
| 2013/0212950 | A1 | 8/2013 | Bertsch et al. | |
| 2017/0292325 | A1 | 10/2017 | Biesinger et al. | |
| 2019/0003250 | A1* | 1/2019 | Flannery | E06B 11/02 |
| 2020/0386049 | A1* | 12/2020 | Kaiser | E06B 9/04 |
| 2020/0408040 | A1 | 12/2020 | Flannery et al. | |
| 2021/0180398 | A1 | 6/2021 | Flannery et al. | |

FOREIGN PATENT DOCUMENTS

| | | | |
|---|---|---|---|
| CN | 206530274 | U | 9/2017 |
| CN | 210217595 | U | 3/2020 |
| DE | 202016002291 | U1 | 6/2016 |
| DE | 202019101550 | U1 | 5/2019 |
| GB | 908306 | A | 10/1962 |
| WO | 93007352 | A1 | 4/1993 |
| WO | 0159246 | A1 | 8/2001 |

* cited by examiner

GATE ASSEMBLY AND KIT

BACKGROUND

Field of the Disclosure

The present disclosure relates to a gate assembly such as a baby gate, and a kit for transport thereof.

Description of the Background of the Disclosure

In the field of baby or safety gates, adjustable gates are configured to fit within a conventional door frame as a popular and effective means of preventing children or pets from entering certain areas. Such areas may contain, for example, potentially hazardous or breakable items that parents and/or homeowners desire to restrict from children or pet interaction. Baby gates are typically constructed of metal, plastic, and/or wood, and can be expanded to fit in a range of doorway widths. They may be designed for use indoors or outdoors, and may be either hardware or pressure-mounted. Such gates are also frequently used to contain small pets.

Pressure-mounted gates are typically held in place by friction when such gates are installed against walls on either side, while hardware-mounted gates are screwed into the wall studs and are operable to swing fully open, in a similar fashion as a door. Conventional pressure-mounted gates, hardware-mounted gates, and mesh retractable gates can be customized to fit wide and/or irregularly shaped openings. In one class of prior art gates, closely-spaced, vertical bars are attached to a supporting structure, and the supporting structure may be adjusted to a width of the door frame. The vertical bars may be made of metal or wood, and are permanently attached to the supporting structure of the gate. For example, vertical bars made of metal may be welded to a metal support structure. Alternatively, vertical bars made of wood may be fastened to a wooden support structure before being shipped or otherwise provided to a consumer.

While welding or fastening the vertical bars to the supporting structure may result in a solidly constructed, rigid gate, the use of such unitary structures can be costly and inconvenient for both the manufacturer and the user. Since the vertical bars are thin, a plurality of vertical bars must be used to serve as a sufficient barrier to prevent children or pets from squeezing through the bars, but when skilled laborers or expensive machines are used to perform the welding or fastening procedures, a greater number of bars translates to a greater cost and time to manufacture each gate. Further, these pre-constructed, unitary gates increase the box size and shipping costs associated with shipping the gates once they are constructed.

Therefore, what is needed is a gate that addresses one or more of the drawbacks of existing gates.

SUMMARY

In one aspect, a gate assembly comprises a support assembly and a gate. The support assembly comprises a first support, a second support, and a base positioned below the first support and the second support. The base comprises a first flange adjacent a first end of the base and a second flange adjacent a second end of the base. The first flange is positioned within the first support and the second flange is positioned within the second support. The first flange and the second flange extend upwardly from a side of the base opposite a ground. The gate comprises an upper rail, a lower rail, and a plurality of posts disposed orthogonally with respect to the upper rail and the lower rail. The plurality of posts are removably engaged with the upper rail and the lower rail. The gate is rotatably attached to the support assembly. The first flange is removably attached to the first support and the second flange is removably attached to the second support.

In some embodiments, the first flange and the second flange comprise a U-shaped cross section. In some embodiments, at least four of the plurality of posts are removably engaged with the upper rail and the lower rail by a plurality of post fasteners. In some embodiments, the first support comprises a first upper spindle assembly and the second support comprises a second upper spindle assembly. In some embodiments, the base comprises a first lower spindle assembly secured to the first end of the base and a second lower spindle assembly secured to the second end of the base. In some embodiments, the first upper spindle assembly, the second upper spindle assembly, the first lower spindle assembly, and the second lower spindle assembly are configured to secure the gate assembly to a wall of an opening. In some embodiments, the first flange comprises a length L4 and the base comprises a length L3, and ratio between the length L4 and the length L3 (L4/L3) is between about 0.08 and about 0.12. In some embodiments, a plurality of auxiliary panels are secured to the support assembly.

In another aspect, a gate assembly comprises a support assembly and a gate. The support assembly comprises a first support, a second support, and a base positioned below the first support and the second support. The base comprises a first flange adjacent a first end of the base and a second flange adjacent a second end of the base. The first flange is removably attached to the first support and the second flange is removably attached to the second support. The first flange and the second flange extend upwardly from a side of the base opposite a ground. The gate comprises an upper rail, a lower rail secured with the base, and a plurality of posts disposed orthogonally with respect to the upper rail and the lower rail. The plurality of posts are removably engaged with the upper rail and the lower rail. The gate is rotatably attached to the support assembly.

In some embodiments, the gate assembly further comprises a plurality of extension assemblies configured to be removably attached with the support assembly, and each of the plurality of extension assemblies add between about 1" (2.5 cm) and about 4" (10 cm) to a width of the gate assembly. In some embodiments, each of the plurality of extension assemblies comprise an upper coupler, a lower coupler, an extension post, an upper extension housing, and a lower extension housing. In some embodiments, the extension posts comprise a greater diameter than the plurality of posts. In some embodiments, a spindle assembly is positioned within each of the upper and lower couplers. In some embodiments, the upper rail of the gate comprises an opening mechanism that is configured to attach with a latch assembly on the first support to lock the gate in place on the support assembly.

In yet another aspect, a kit for a gate assembly comprises a support assembly, a gate, and a plurality of spindle assemblies. The support assembly comprises a first support, a second support, and a base positioned below the first support and the second support. The base comprises a first flange adjacent a first end of the base and a second flange adjacent a second end of the base. The first flange is removably attached to the first support and the second flange is removably attached to the second support. The first flange and the second flange extend upwardly from a side of the base opposite a ground. The gate comprises an upper rail, a lower rail, and a plurality of posts disposed orthogonally with respect to the upper rail and the lower rail. The plurality of posts are removably engaged with the upper rail and the lower rail. The gate assembly defines a plurality of gate assembly dimensions. Components that comprise the support assembly, the gate, and the plurality of spindle assemblies are contained in a package that defines a plurality of packaging dimensions. At least one of the plurality of packaging dimensions is smaller than at least one of the corresponding gate assembly dimensions.

In some embodiments, the kit further includes a plurality of extension assemblies. In some embodiments, the plurality of extension assemblies each add between about 1" (2.5 cm) and about 4" (10 cm) to a width of the gate assembly. In some embodiments, the first support, the second support, the base, the upper rail, the lower rail, and the plurality of posts are configured to extend substantially parallel to each other in the kit for the gate assembly. In some embodiments, the base comprises a length L3 and the gate comprises a width WF, and the length L3 is larger than the width WF. In some embodiments, the first support comprises a length L1 and the base comprises a length L3, and a ratio between the length L3 and the length L1 (L3/L1) is at least 0.9.

DETAILED DESCRIPTION

The following discussion and accompanying figures disclose various embodiments or configurations of a knock down gate and kit for assembly thereof that is capable of being secured between two static structures, such as walls, or within a doorway. Although embodiments of a knock down gate assembly are disclosed that are specific to pressure-mounted based securement of the gate, concepts associated with embodiments of the assembly may be implemented with a wide variety of baby gate assemblies, including doorway-based gates, banister gates including baby gates intended to be used at the top or bottom of stairwells, swing-open gates, pressure-fit gates, hardware-retaining gates, lockable gates, or any other type of gate that prevents ingress or egress of a baby, toddler, or pet from one room to another or from one space to another space. Accordingly, concepts described herein may be utilized in a variety of products and in a variety of applications.

The term "about," as used herein, refers to variations in the numerical quantity that may occur, for example, through typical measuring and manufacturing procedures used for knock down gate assembly manufacturing, or other articles of manufacture that may include embodiments of the disclosure herein, through inadvertent error in these procedures, through differences in the manufacture, source, or purity of the ingredients used to make the compositions or mixtures or carry out the methods, and the like. Throughout the disclosure, the terms "about" and "approximately" refer to a range of values±5% of the numeric value that the term precedes. As noted herein, all ranges disclosed within this application are inclusive of the outer bounds of the range.

Figure 1:
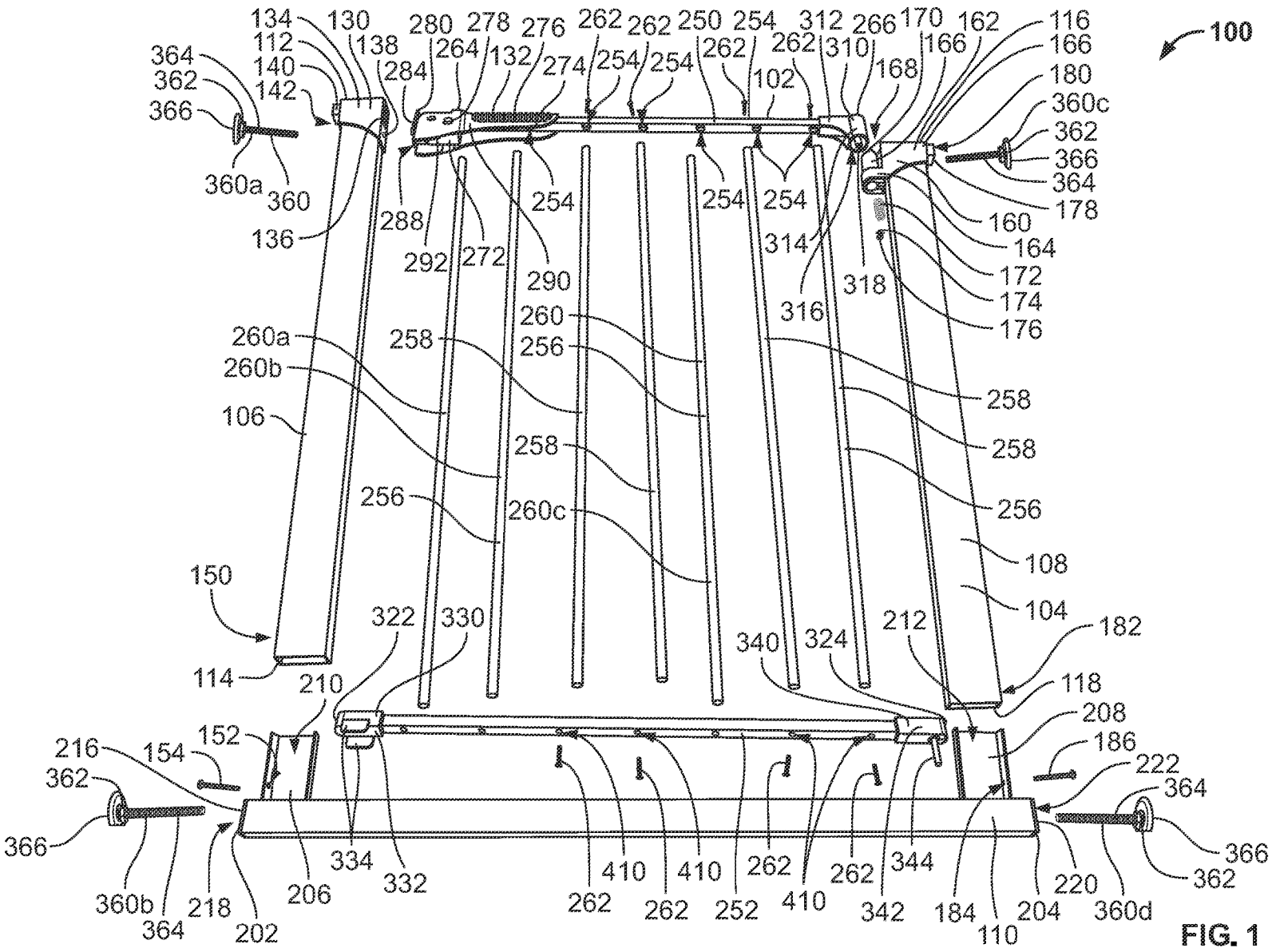
FIG. 1 is a front and bottom perspective view of a knock down gate assembly that is shown in a disassembled state.

Referring to FIG. 1, a knock down gate assembly 100 is shown in a disassembled state. The gate assembly 100 is formed from steel. However, it is contemplated that the gate assembly 100 can be formed from any type of metal, e.g., aluminum, iron, etc. Further, in some embodiments, the gate assembly 100 can be formed from plastic, wood, other metals or metal alloys, combinations thereof, or any other alternative material. It is contemplated that the gate assembly 100 can be formed from any suitable material. The knock down gate assembly 100 comprises a gate 102 and a support assembly 104. The support assembly 104 comprises a first support 106, a second support 108, and a base 110, and the first support 106, the second support 108, and the base 110 are hollow. In some embodiments, the first support 106, the second support 108, and the base 110 may not be hollow. As illustrated in FIG. 1, the first support 106 is substantially straight and vertical and comprises a first upper end 112 and a first lower end 114 adjacent the base 110. Similarly, the second support 108 is substantially vertical and vertical and comprises a second upper end 116 and a second lower end 118. The first support 106 and the second support 108 comprise a generally rectangular cross-section. However, in some embodiments, the first support 106 and the second support 108 may comprise a non-rectangular cross-section, e.g., circular, oval, square, elliptic, triangular, etc.

Still referring to FIG. 1, the first upper end 112 of the first support 106 comprises a latch assembly 130 thereon. The latch assembly 130 is configured to interact with an opening mechanism or handle assembly 132 to secure the gate assembly 100 in a closed state. The latch assembly 130 comprises a latch housing 134 having a first ribbed surface 136 and a protrusion 138 extending outwardly from the latch housing 134 below the first ribbed surface 136. The protrusion 138 comprises a generally triangular cross section. In some embodiments, the protrusion 138 may have a square, rectangular, circular, or oval cross-section. As will be discussed in further detail below, the protrusion 138 acts as a key to secure the handle assembly 132 to the latch assembly 130 (see FIGS. 6 and 8). Opposite the protrusion 138, the latch assembly 130 also comprises a first upper housing 140 protruding out from a side of the first support 106, opposite the gate 102. The first upper housing 140 defines a first upper slot 142 having a rectangular cross-section. The first upper slot 142 extends into the latch assembly 130 of the first support 106. The first support 106 also comprises a first support aperture 150 that extends through the side of the first support 106, opposite the gate 102 (see FIG. 5). The first support aperture 150 is configured to align with a first base aperture 152 on the base 110 and receive a first support fastener 154 therethrough. The first support fastener 154 is configured to secure the first support 106 to the base 110.

Still referring to FIG. 1, the second upper end 116 of the second support 108 comprises a mounting assembly 160 thereon. The mounting assembly 160 is configured to secure the gate 102 to the support assembly 104. The mounting assembly 160 comprises a mounting housing 162 having a ledge 164 that extends outwardly on a side of the second support 108 facing the gate 102. The ledge 164 comprises a mounting sleeve 166 extending upwardly therefrom. The mounting sleeve 166 is generally cylindrical and comprises a passageway 168 therethrough, and the mounting sleeve 166 comprises two sleeve protrusions or tips 170 extending from a top edge of the mounting sleeve 166 on diametrically opposed sides of the mounting sleeve 166 (only one tip 170 shown in FIG. 1). Further, the mounting sleeve 166 comprises a radial flange (not shown) extending within the passageway 168 of the mounting sleeve 166. The gate 102 is configured to be secured on the mounting sleeve 166, and the mounting sleeve 166 allows the gate 102 to rotate about the support assembly 104. The sleeve protrusions or tips 170 assist with the rotation of the gate 102 when the gate 102 is secured to the support assembly 104, i.e., the tips 170 act as a bearing for the gate 102 to rotate on. As illustrated in FIG. 1, the mounting assembly 160 also comprises a spring 172, a washer 174, and a mounting fastener 176 therein that assists with securing the gate 102 to the mounting assembly 160. Opposite the ledge 164, the mounting assembly 160 also comprises a second upper housing 178 protruding out from a side of the mounting assembly 160 opposite the gate 102. The second upper housing 178 defines a second upper slot 180 having a rectangular cross-section. The second upper slot 180 extends into the mounting housing 162 of the second support 108. Similar to the first support 106, the second support 108 also comprises a second support aperture 182 that extends through a side of the second support 108, opposite the gate 102. The second support aperture 182 is configured to align with a second base aperture 184 on the base 110 and receive a second support fastener 186 therethrough. The second support fastener 186 is configured to secure the second support 108 to the base 110.

Still referring to FIG. 1, the base 110 extends along the bottom of the gate assembly 100 and comprises a first end 202 adjacent the first support 106 and a second end 204 adjacent the second support 108. As illustrated in FIG. 1, the base 110 is substantially straight and extends horizontally along the bottom of the gate assembly 100 (see FIG. 6). During use, the base 110 is positioned on the floor, ground, or a staircase. Similar to the first support 106 and the second support 108, the base 110 comprises a rectangular cross-section. However, in some embodiments, the base 110 can include a square, circular, oval, triangular, or irregular cross-section. As further illustrated in FIG. 1, the base 110 comprises a first flange 206 adjacent the first end 202 of the base 110 and a second flange 208 adjacent the second end 204 of the base. The first flange 206 comprises a U-shaped cross-section defining a first channel 210 therein. Similarly, the second flange 208 also comprises a U-shaped cross-section defining a second channel 212 therein. In some embodiments, the first flange 206 and the second flange 208 may comprise a rectangular cross-section. As discussed above, on a side of the first flange 206, opposite the gate 102, the first flange 206 comprises the first base aperture 152 extending therethrough. Further, on a side of the second flange 208, opposite the gate 102, the second flange 208 comprises the second base aperture 184 extending therethrough. As noted herein, the first base aperture 152 and the second base aperture 184 only extend through one side of the flange 206, 208, i.e., the side opposite the gate 102. In some embodiments, the first base aperture 152 and the second base aperture 184 extend through both sides of the first flange 206 and the second flange 208, respectively. In some embodiments, the first flange 206 and the second flange 208 are welded to the base 110. However, it is contemplated that the first flange 206 and the second flange 208 can be secured to the base 110 in any known fastening way.

Figure 5:
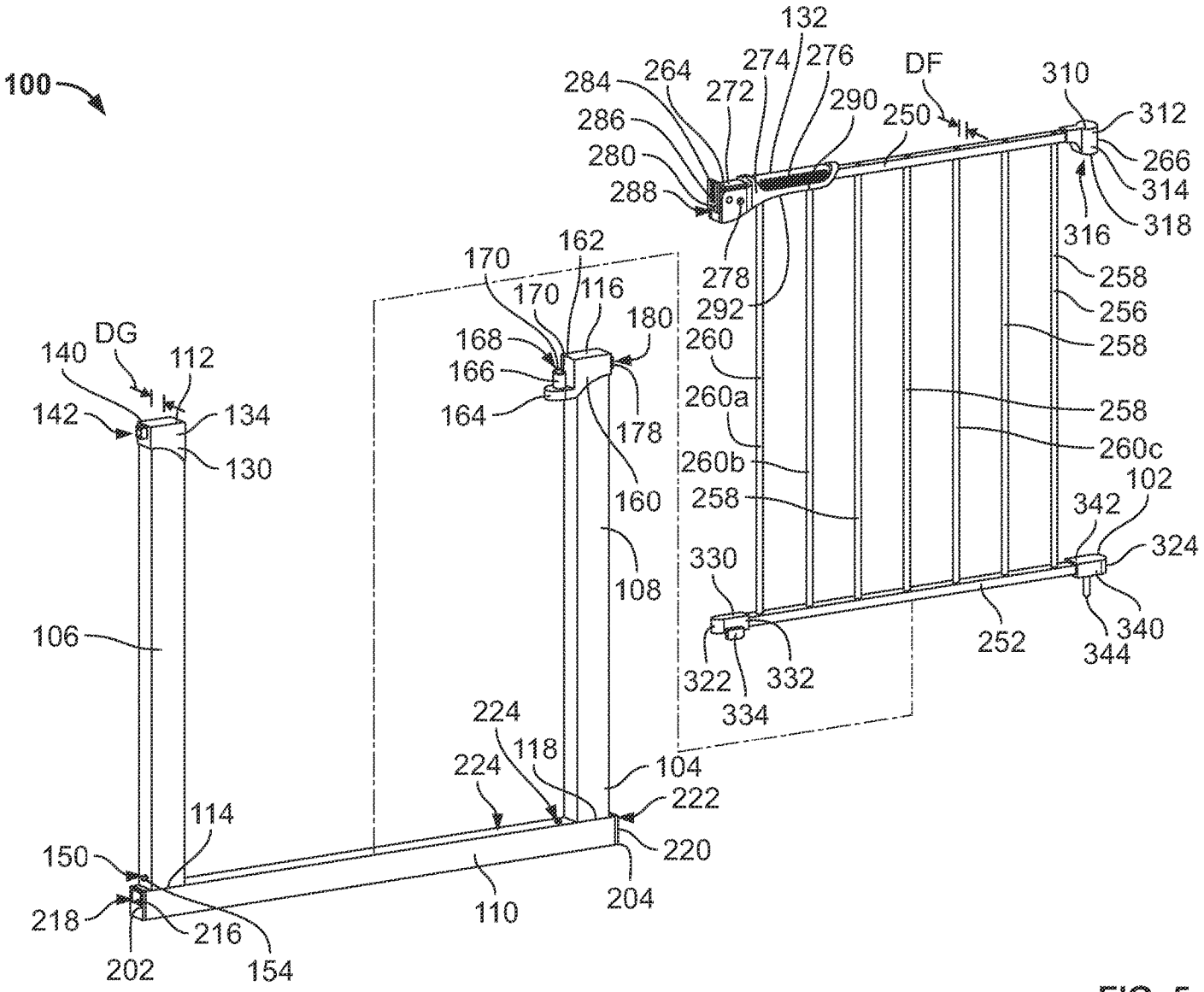
FIG. 5 is an exploded perspective view of the support assembly of FIG. 3 and the gate of FIG. 4 in an assembled state.

Still referring to FIG. 1, the first end 202 of the base 110 comprises a first lower housing 216 defining a first lower slot 218. The first lower slot 218 comprises a rectangular cross section. The second end 204 of the base 110 comprises a second lower housing 220 defining a second lower slot 222. The second lower slot 222 also comprises a rectangular cross section. As will be discussed in greater detail below, the first lower slot 218 and the second lower slot 222 are similar to the first upper slot 142 and the second upper slot 180. Further, the base 110 comprises a gate aperture 224 adjacent the second flange 208 (FIG. 5). The gate aperture 224 extends through a side of the base 110 that faces the gate 102. As discussed below, the gate aperture 224 is configured to receive a portion of the gate 102 therein. As noted herein, the gate aperture 224 only extends through one side of the base 110.

Figure 2:
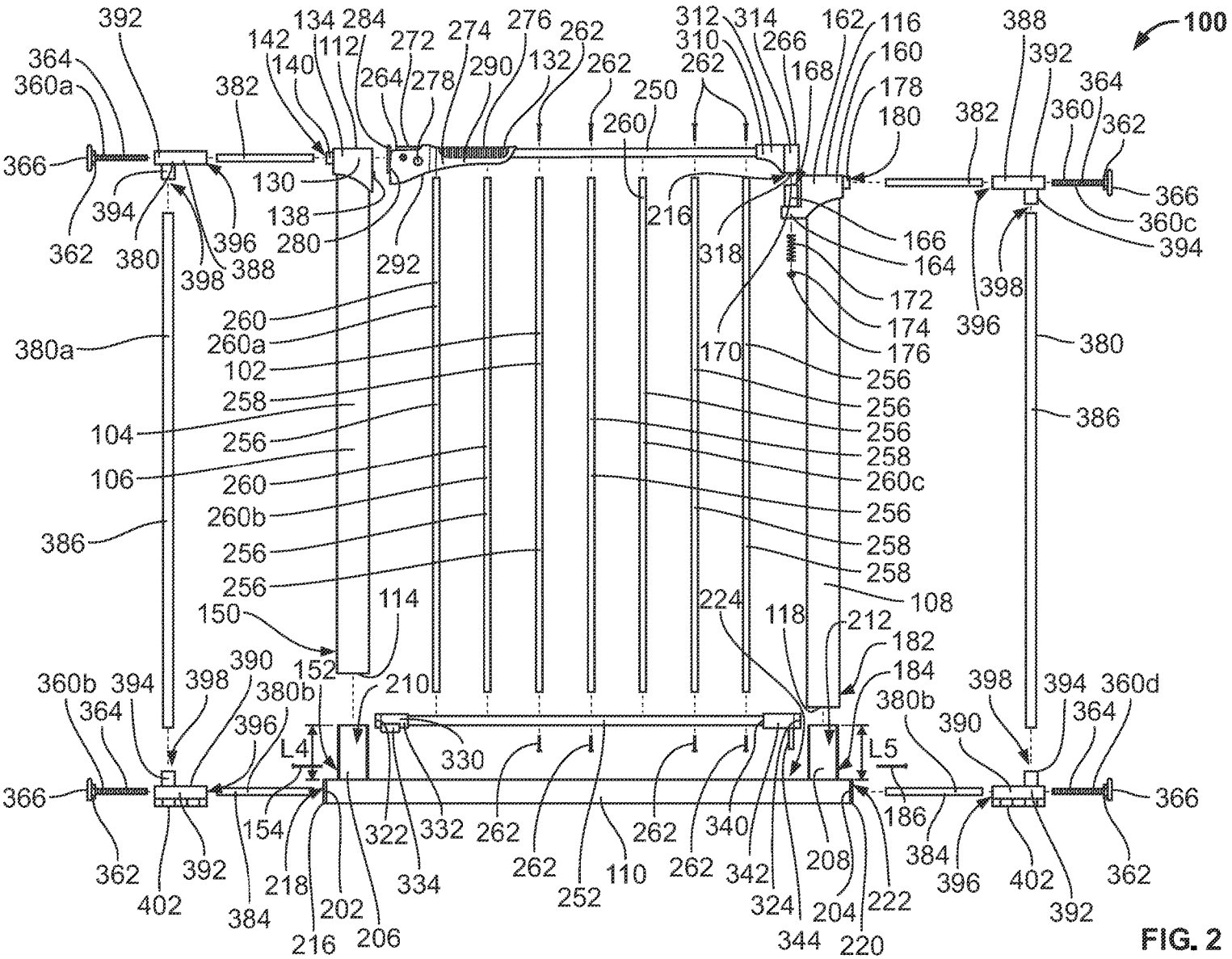
FIG. 2 is a front elevational view of the knock down gate assembly of FIG. 1 with a plurality of extension assemblies.
Figure 3:
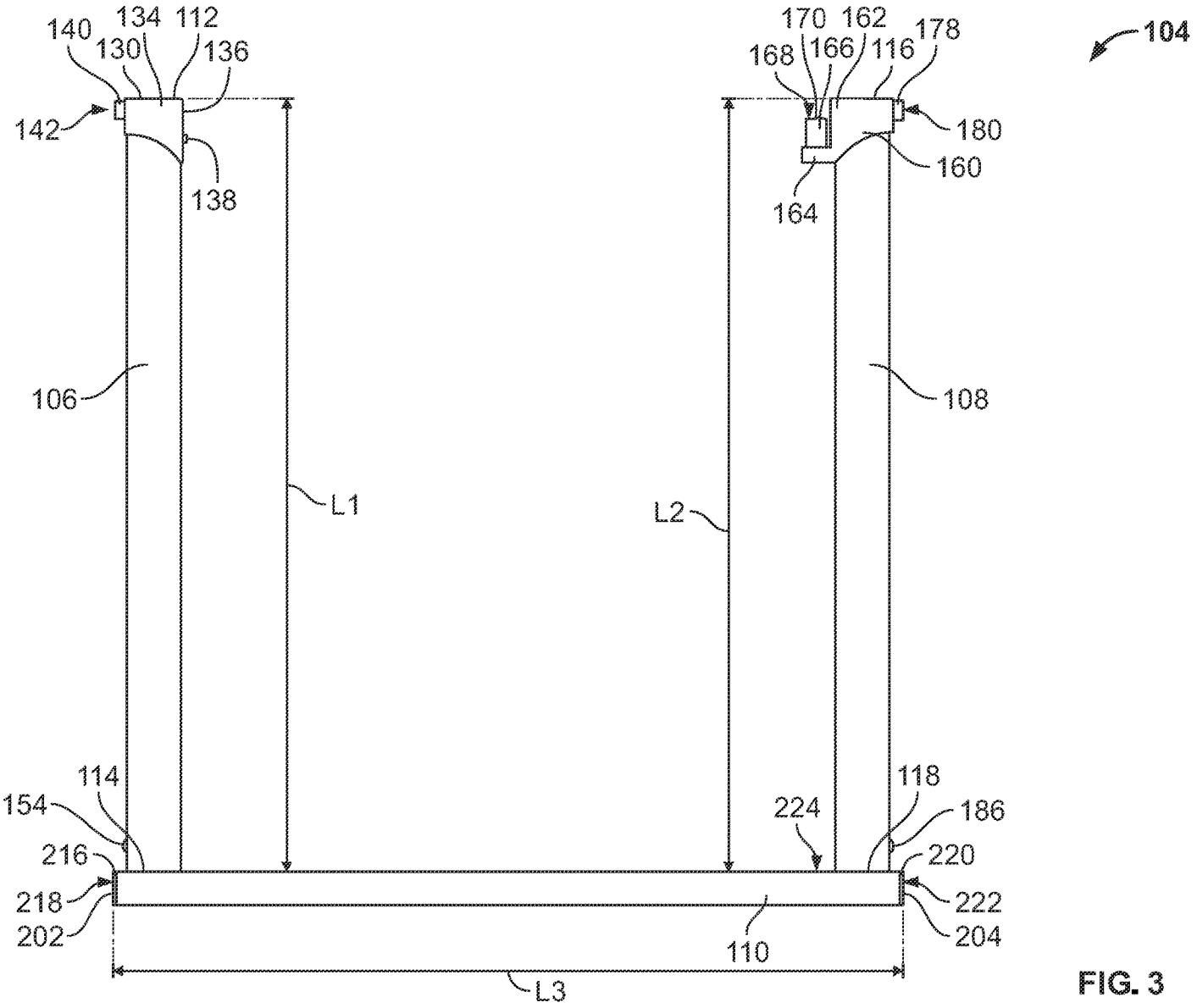
FIG. 3 is a front elevational view of a support assembly of the knock down gate assembly of FIGS. 1 and 2 in an assembled state.

Referring specifically to FIG. 3, the first support 106 comprises a length L1, the second support 108 comprises a length L2, and the base 110 comprises a length L3. Further, as illustrated in FIG. 2, the first flange 206 of the base 110 comprises a length L4 and the second flange 208 of the base 110 comprises a length L5. In some embodiments, the length L1 and the length L2 may be equal. Furthermore, in some embodiments, the length L1 may be greater or smaller than the length L2. Still further, in some embodiments, the length L4 can be equal to the length L5. Further, in some embodiments, the length L4 may be greater or smaller than the length L5.

In some embodiments, the length L1 and the length L2 are between about 15" (38 cm) and about 70" (178 cm), or about 15" (38 cm) and about 50" (127 cm), or about 20" (51 cm) and about 30" (76 cm), or about 28.25" (72 cm), or at least 15" (38 cm), or at least 20" (51 cm), or at least 25" (64 cm). In some embodiments, the length L3 is between about 15" (38 cm) and about 70" (178 cm), or about 15" (38 cm) and about 50" (127 cm), or about 20" (51 cm) and about 30" (76 cm), or about 27.5" (70 cm), or at least 15" (38 cm), or at least 20" (51 cm), or at least 25" (64 cm). In some embodiments, the length L4 and the length L5 are between about 0.1" (0.3 cm) and about 25" (64 cm), or about 1" (2.5 cm) and about 10" (25 cm), or about 2" (5 cm) and about 3" (7.6 cm), or about 2.6" (6.7 cm), or about 2.75" (7 cm), or at least 0.1" (0.25 cm), or at least 1" (2.5 cm), or at least 2" (5.1 cm), or at least 3" (7.6 cm).

In some embodiments, a ratio between the length L4 and the length L3 (L4/L3) is between about 0.01 and about 0.5, or about 0.05 and about 0.02, or about 0.05 and about 0.15, or about 0.08 and about 0.12, or about 0.09 and about 0.11, or about 0.09, or about 0.1, or at least 0.01, or at least 0.05, or at least 0.09, or at least 0.1. In some embodiments, a ratio between the length L5 and the length L3 (L5/L3) is between about 0.01 and about 0.5, or about 0.05 and about 0.02, or about 0.05 and about 0.15, or about 0.08 and about 0.12, or about 0.09 and about 0.11, or about 0.09, or about 0.1, or at least 0.01, or at least 0.05, or at least 0.09, or at least 0.1.

In some embodiments, a ratio between the length L4 and the length L1 (L4/L1) is between about 0.01 and about 0.5, or about 0.04 and about 0.2, or about 0.05 and about 0.15, or about 0.09 and about 0.11, or about 0.09 and about 0.1, or about 0.09, or about 0.1, or at least 0.01, or at least 0.04, or at least 0.05, or at least 0.09, or at least 0.1. In some embodiments, a ratio between the length L5 and the length L2 (L5/L2) is between about 0.01 and about 0.5, or about 0.04 and about 0.2, or about 0.05 and about 0.15, or about 0.09 and about 0.11, or about 0.09 and about 0.1, or about 0.09, or about 0.1, or at least 0.01, or at least 0.04, or at least 0.05, or at least 0.09, or at least 0.1.

In some embodiments, a ratio between the length L3 and the length L1 (L3/L1) is between about 0.4 and about 1.5, or about 0.6 and about 1.1, or about 0.9 and about 1.0, or about 0.95, or at least 0.4, or at least 0.6, or at least 0.8, or at least 0.9, or at least 1.0. In some embodiments, a ratio between the length L3 and the length L2 (L3/L2) is between about 0.4 and about 1.5, or about 0.6 and about 1.1, or about 0.9 and about 1.0, or about 0.95, or at least 0.4, or at least 0.6, or at least 0.8, or at least 0.9, or at least 1.0.

Referring back to FIG. 1, the gate 102 comprises an upper rail 250 and a lower rail 252. The upper rail 250 and the lower rail 252 are disposed at opposing ends of the gate 102, and each includes a plurality of post receiving apertures 254. The post receiving apertures 254 are sized and shaped to receive ends of a plurality of posts 256, which are generally disposed orthogonally with respect to the upper rail 250 and the lower rail 252. The plurality of posts 256 may comprise a plurality of fastening posts 258 and a plurality of cylindrical posts 260. As noted herein, the upper rail 250, the lower rail 252, and the plurality of posts 256 are substantially hollow.

Referring to the specific orientation shown in FIG. 1, a first and second cylindrical post 260*a*, 260*b* are disposed at a far-left side of the gate 102, and a third cylindrical post 260*c* is disposed between the plurality of fastening posts 258. The plurality of cylindrical posts 260 aid in assembly of the gate 102, as discussed in greater detail hereinafter below. The plurality of cylindrical posts 260 are inserted into the post receiving apertures 254 that are the same size as the post receiving apertures 254 that receive the fastening posts 258. As noted herein, the gate 102 comprises three cylindrical posts 260 and four fastening posts 258. However, it is contemplated that the gate 102 can comprise any number of cylindrical posts 260 and/or fastening posts 258. For example, in some embodiments, the third cylindrical post 260*c* may be a fastening post 258 or all of the posts may be cylindrical posts 260*c* or fastening posts 258.

Still referring to FIG. 1, a plurality of post fasteners 262 are shown, which may be bolts, screws, or other fasteners known to those of ordinary skill in the art. The post fasteners 262 may be inserted into the upper rail 250 and the lower rail 252, and engage with the fastening posts 258. In the present embodiment, the gate 102 comprises four fastening posts 258 that engage with the post fasteners 262. However, as discussed above, the gate 102 may comprise more or fewer fastening posts 258. As noted herein, the plurality of cylindrical posts 260 are not fastened to the rails 250, 252; rather, upper and lower ends of the plurality of cylindrical posts 260 are retained within the post receiving apertures 254 when the rails 250, 252 are fastened to the plurality of fastening posts 258. In alternative embodiments, more or all of the plurality of cylindrical posts 260 are constructed as fastening posts 258, and are rigidly fastened to the rails 250, 252 via the post fasteners 262, adhesive, or another means of fastening.

As noted herein the fastening posts 258 may comprise the same diameter as the cylindrical posts 260. As a result, the sizes of the post receiving apertures 254 are consistent to snugly or fittingly receive whichever of the plurality of posts 256 is being inserted into each post receiving aperture 254. While the diameters of the plurality of posts 256 are the same in the present embodiment, it is contemplated that alternative diameters of the plurality of posts 256 may be practiced. Further, alternative post configurations are also contemplated, and the plurality of posts 256 may have other, non-circular cross sections or cross-sections that vary in diameter along a length of the plurality of posts 256. In some embodiments, one or more of the posts 256 may have a wave-like pattern along a length thereof. Furthermore, in some embodiments, the plurality of cylindrical posts 260 may comprise a first diameter and the plurality of fastening posts 258 may comprise a second diameter, different than the first diameter, i.e., the plurality of fastening posts 258 may have a larger diameter or a smaller diameter than the plurality of cylindrical posts 260.

As further illustrated in FIG. 1, the plurality of fastening posts 258 and the plurality of cylindrical posts 260 have the same vertical length, i.e., vertical direction in FIG. 2. However, in alternative embodiments, the plurality of fastening posts 258 may be shorter or taller than the plurality of cylindrical posts 260. In some embodiments, the plurality of cylindrical posts 260 may be shorter than the plurality of fastening posts 258, allowing hardware to be inserted into the horizontal upper and lower rails 250, 252 into the spaces in-line with the plurality of cylindrical posts 260. The plurality of fastening posts 258 may be formed with internal threading to allow the post fasteners 262 to engage with the plurality of fastening posts 258, which thereby retains the plurality of fastening posts 258 with the rails 250, 252. In one aspect, the internal threading may be formed directly on an internal surface of the plurality of fastening posts 258. Alternatively, in another aspect, the internal threading may be achieved by welding, adhering, or otherwise coupling a threaded nut into one or both of the upper and lower ends of the plurality of fastening posts 258. As discussed above, the plurality of cylindrical posts 260 are placed inside of the frame and "sandwiched" by the rails 250, 252. The gate 102 is preferably disposed in an orientation similar to that shown in FIG. 1 immediately before fastening and assembling the various components.

Figure 8:
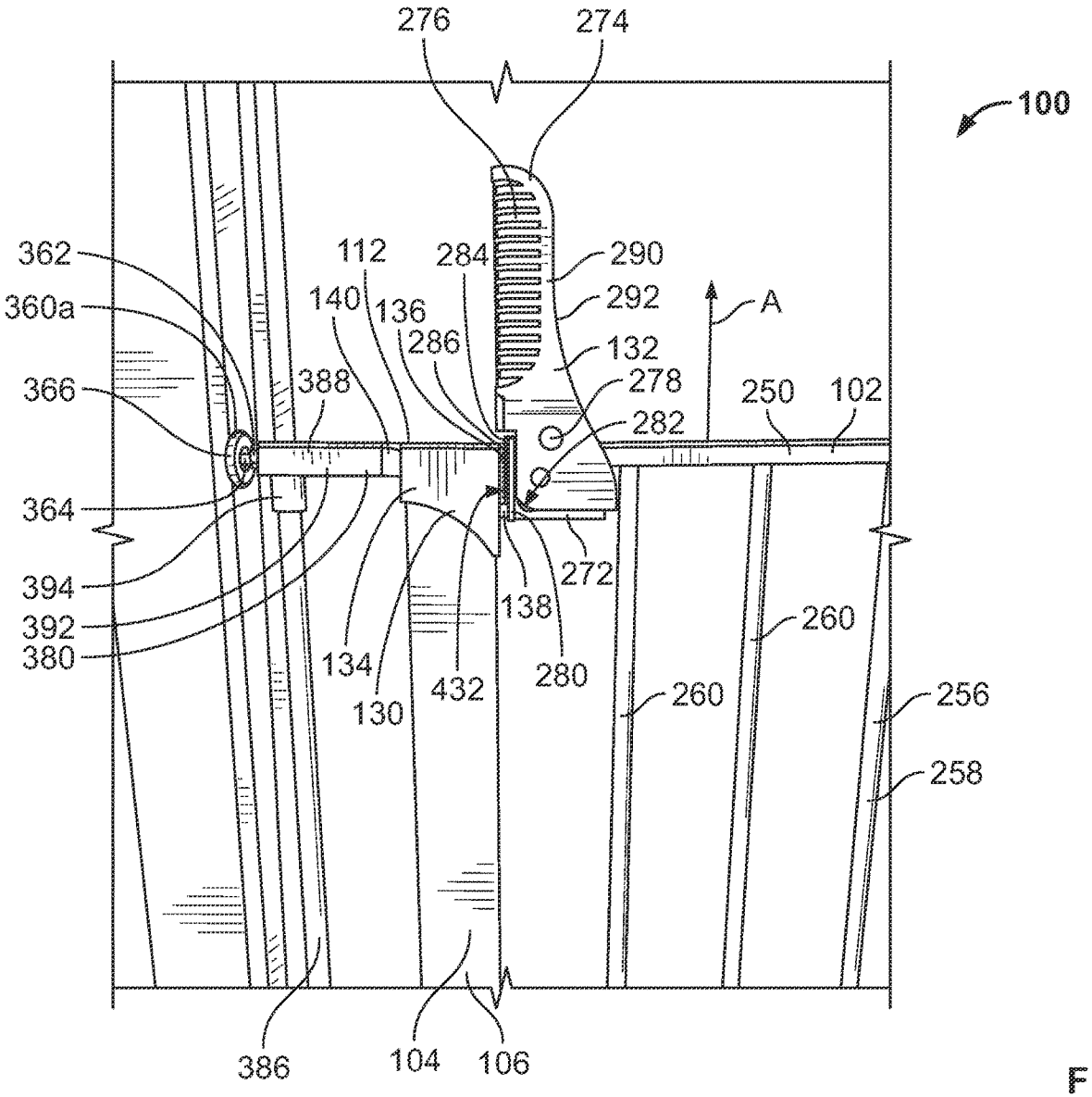
FIG. 8 is a zoomed in view of a handle assembly of FIG. 7.

Still referring to FIG. 1, the upper rail 250 comprises a first upper rail end 264 and a second upper rail end 266, opposite the first upper rail end 264. The opening mechanism or handle assembly 132 is positioned on the first upper rail end 264 of the upper rail 250. The handle assembly 132 comprises a handle housing 272 and a handle sleeve 274. The handle sleeve 274 comprises a grip 276 thereon. As illustrated in FIG. 8, the handle sleeve 274 is configured to rotate about the handle housing 272 between a first configuration (see FIG. 1), i.e., closed position, and a second configuration (see FIG. 8), i.e., open position. As illustrated in FIG. 1, the handle assembly 132 comprises a button 278 on both sides of the handle assembly 132 (only one button 278 is illustrated). The button 278 is configured to allow the handle sleeve 274 to move between the first configuration and the second configuration, i.e., a user presses both buttons 278 on both sides to move the handle sleeve 274 from the first configuration to the second configuration.

Still referring to FIG. 1, the handle housing 272 further comprises an arm 280 extending outwardly therefrom. With reference specifically to FIG. 1, the arm 280 extends outwardly from the left side of the handle housing 272 and comprises an arm slot 282 (see FIG. 8) on both sides of the arm 280 (only one arm slot 282 shown in FIG. 8) and an arm wall 284. The arm slots 282 interact with internal cams (not shown) within the handle sleeve 274. In particular, the arm slots 282 and the internal cams (not shown) are configurated such that the handle sleeve 274 linearly translates the arm wall 284, away from the handle housing 272, while the handle sleeve 274 rotates about the handle housing 272. Therefore, the arm wall 284 is configurated to horizontally translate between a first configuration and a second configuration, depending on the first and second configuration of the handle sleeve 274.

Referring to FIGS. 1 and 5, the arm wall 284 comprises a second ribbed surface 286 and a groove 288 positioned below the second ribbed surface 286. The groove 288 has a generally triangular shape with an opening at the bottom. The groove 288 is configurated to mate with the protrusion 138 on the latch assembly 130 to lock the gate 102 in place on the support assembly 104. As illustrated in FIG. 1, the handle sleeve 274 comprises a sidewall 290 having an edge 292 with various splines and curves therein. Specifically, the sidewall 290 comprises a concave and convex edge.

Figure 6:
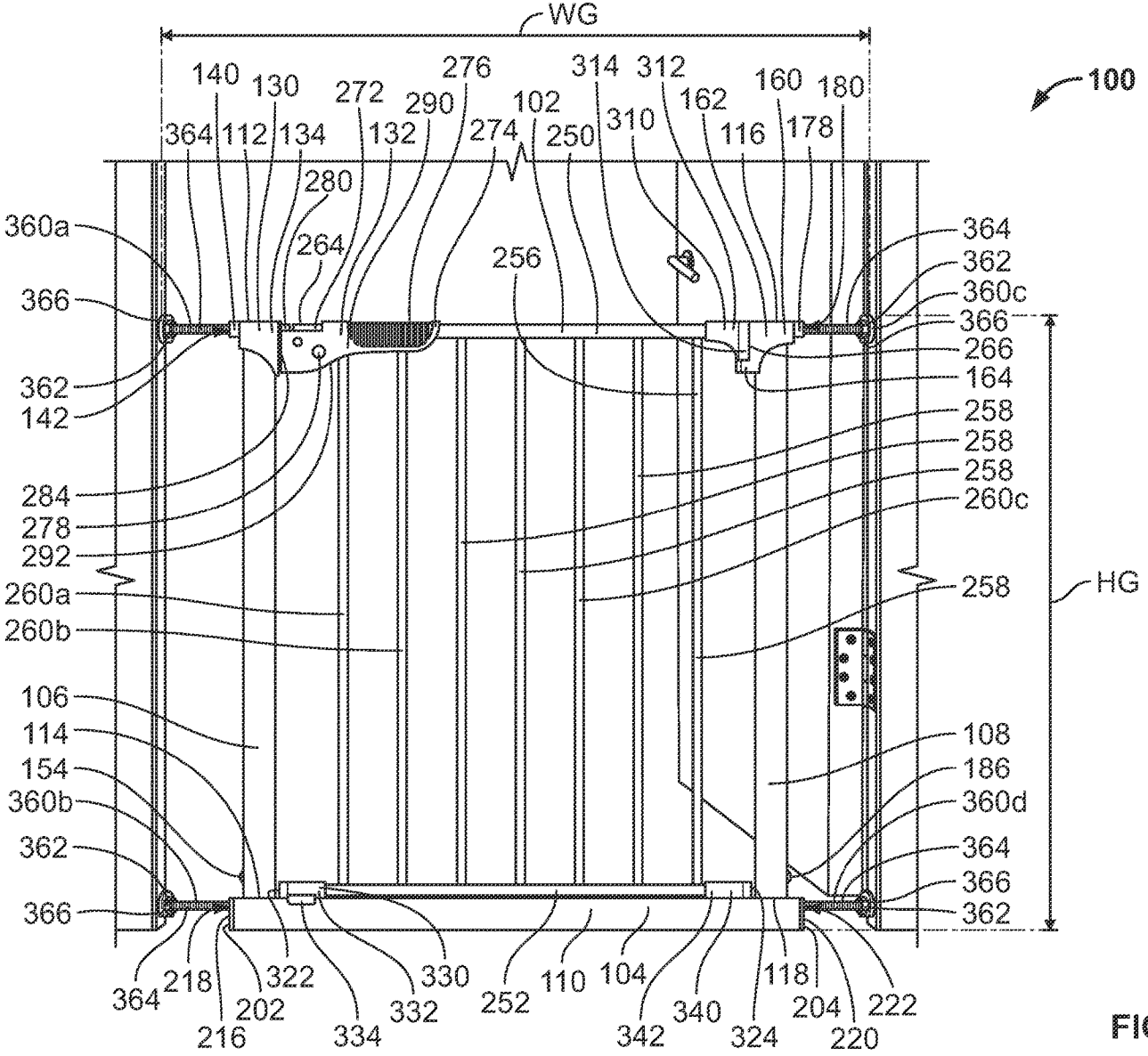
FIG. 6 is a front elevational view of the knock down gate assembly of FIG. 1 in an assembled and installed state.

Still referring to FIG. 1, the upper rail 250 comprises an upper pin assembly 310 on the second upper rail end 266. The upper pin assembly 310 comprises an upper pin housing 312 having a pin sleeve 314. The pin sleeve 314 is generally cylindrical and defines a pin chamber 316. An upper pin 318 extends through the pin chamber 316 and is also substantially cylindrical. During use, the upper pin 318 is configured to extend into the mounting sleeve 166 on the mounting assembly 160 of the second support 108. In particular, the upper pin 318 extends into the passageway 168 of the mounting sleeve 166, between the radial flange (not shown) of the mounting sleeve 166. As a result of the upper pin 318 being positioned within the passageway 168 of the mounting sleeve 166, the mounting sleeve 166 is positioned within the pin chamber 316 of the pin sleeve 314. Therefore, as illustrated in FIG. 6, once assembled, the mounting sleeve 166 is substantially or completely covered by the upper pin housing 312, i.e., the pin sleeve 314.

With continued reference to FIG. 1, the lower rail 252 comprises a first lower rail end 322 and a second lower rail end 324. As illustrated in FIG. 1, the lower rail 252 comprises a clamp assembly 330 positioned on the first lower rail end 322 of the lower rail 252. The clamp assembly 330 comprises a clamp housing 332 and a clamp 334 extending from the clamp housing 332. The clamp 334 is configured to secure to or on the side of the base 110 facing the gate 102 (see FIG. 6). The clamp 334 allows the gate 102 to be secured to the base 110 when the gate 102 is in the closed configuration, i.e., the handle assembly 132 is secured on the latch assembly 130.

Still referring to FIG. 1, the lower rail 252 further comprises a lower pin assembly 340 positioned on the second lower rail end 324 of the lower rail 252. The lower pin assembly 340 comprises a lower pin housing 342 and a lower pin 344 extending from the lower pin housing 342. As noted herein, the lower pin 344 is formed from steel. However, in some embodiments, the lower pin 344 may be formed from another metal or from plastic. The lower pin 344 is configured to be inserted through the gate aperture 224 in the base 110. Therefore, the gate 102 is configured to rotate about the upper pin 318 and the lower pin 344 between the open position and the closed position.

As noted herein, the latch assembly 130, the mounting assembly 160, the handle assembly 132, the upper pin assembly 310, the lower pin assembly 340, and the clamp assembly 330 are all formed from plastic, e.g., injection molding. In some embodiments, the latch assembly 130, the mounting assembly 160, the handle assembly 132, the upper pin assembly 310, the lower pin assembly 340, and the clamp assembly 330 may be formed from metal, e.g., steel, aluminum, etc. (see FIGS. 10-13).

Still referring to FIG. 1, the gate assembly 100 further includes a plurality of spindle assemblies 360. In particular, the plurality of spindle assemblies 360 include a first upper spindle assembly 360*a*, a first lower spindle assembly 360*b*, a second upper spindle assembly 360*c*, and a second lower spindle assembly 360*d*. Each of the plurality of spindle assemblies 360 comprises a nut 362 and a threaded portion 364 attached to a latch or head portion 366. The head 366 of the first upper spindle assembly 360*a* and the second upper spindle assembly 360*c* is substantially circular while the head 366 of the first lower spindle assembly 360*b* and the second lower spindle assembly 360*d* comprises a half circle or three-fourths circle such that it can be placed on the ground or floor. As illustrated in FIG. 1, the threaded portion 364 of the first upper spindle assembly 360*a* is configured to be inserted into the first upper slot 142 of the first upper housing 140, the threaded portion 364 of the second upper spindle assembly 360*c* is configured to be inserted into the second upper slot 180 of the second upper housing 178, the threaded portion 364 of the first lower spindle assembly 360*b* is configured to be inserted into the first lower slot 218 of the first lower housing 216, and the threaded portion 364 of the second lower spindle assembly 360*d* is configured to be inserted into the second lower slot 222 of the second lower housing 220. The plurality of spindle assemblies 360 are configured to secure onto a door frame or wall of an opening. In some embodiments, the heads 366 of the plurality of spindle assemblies 360 may comprise a plastic covering in order to limit scratches on the door frame or wall. Further, in some embodiments, spindle housings (not shown) may be added within the first upper slot 142, the second upper slot 180, the first lower slot 218, and the second lower slot 222 before the plurality of spindle assemblies 360 are respectively added therein. Alternative configurations of the plurality of spindle assemblies 360 are contemplated. For example, in some embodiments, the plurality of spindle assemblies 360 may be similar to the spindle assemblies disclosed in U.S. Pat. No. 11,118,398, which is incorporated herein by reference in its entirety. Alternative spindle assemblies may also be utilized, depending on the desired functionality of the gate assembly 100.

Referring to FIG. 2, the knock down gate assembly 100 is shown in a disassembled state with a plurality of extension assemblies 380. Depending on the size of the doorway, opening, or stairway, the plurality of extension assemblies 380 may be added to the gate assembly 100 to increase the total width of the gate assembly 100. Referring specifically to FIG. 2, the left side of the gate assembly 100 comprises a first extension assembly 380*a* and the right side of the gate assembly 100 comprises a second extension assembly 380*b*. However, in some embodiments, only one side of the gate assembly 100 may comprise the extension assembly 380. Further, in some embodiments, multiple extension assemblies 380 may be added to each side of the gate assembly 100.

Still referring to FIG. 2, each of the plurality of extension assemblies 380 comprises an upper coupler 382, a lower coupler 384, an extension post 386, an upper extension housing 388, and a lower extension housing 390. The upper coupler 382 and the lower coupler 384 are substantially the same and are formed from metal, i.e., steel. Further, the upper coupler 382 and the lower coupler 384 are hollow and form a general rectangular prism. As illustrated in FIG. 2, the upper coupler 382 is configured to be inserted into the first upper slot 142 and/or the second upper slot 180. Similarly, the lower coupler 384 is configured to be inserted into the first lower slot 218 and the second lower slot 222.

Still referring to FIG. 2, the upper extension housings 388 and the lower extension housings 390 each comprises a housing portion 392 and a cylindrical portion 394 extending orthogonal to the housing portion 392. The housing portions 392 are hollow and comprise a rectangular cross section that matches the shape of the upper coupler 382 and the lower coupler 384. Specifically, each of the housing portions 392 comprise an extension passageway 396 extending therethrough. The cylindrical portions 394 are also hollow and each comprises an extension cavity 398 therein. As noted herein, the extension cavities 398 do not connect with the extension passageways 396. Instead, the extension cavities 398 are configured to receive and retain the extension posts 386. As noted herein, each of the lower extension housings 390 comprise an extension flange 402 extending from a bottom (with reference to FIG. 2) of the housing portions 392. The extension flanges 402 make contact with the floor or ground and level the lower extension housings 390 such that the extension cavity 398 is aligned with the first and second lower slots 218, 222. Therefore, once the upper couplers 382 and the lower couplers 384 are secured within the first and second upper slots 142, 180 and the first and second lower slots 218, 222, respectively, the upper extension housings 388 and the lower extension housings 390 can slide on the remaining portion of the upper and lower couplers 382, 384 that extend outwardly from the support assembly 104.

Still referring to FIG. 2, the extension posts 386 extend between the cylindrical portions 394 of the upper and lower extension housings 388, 390. The extension posts 386 are made of metal and are similar to the fastening posts 258 and/or the cylindrical posts 260 described above. In particular, the extension posts 386 have the same vertical length as the fastening posts 258 and the cylindrical posts 260. However, in some embodiments, the extension posts 386 can have a longer or shorter vertical length than the fastening posts 258 and/or the cylindrical posts 260. As illustrated in FIG. 2, the extension posts 386 comprise a larger diameter than the fastening posts 258 and the cylindrical posts 260. However, in alternative embodiments, the extension posts 386 may comprise the same diameter as the fastening posts 258 and/or the cylindrical posts 260. During use, the extension posts 386 are configured to snuggly fit within the extension passageways 396 of the cylindrical portions 394 of the upper and lower extension housings 388, 390.

Still referring to FIG. 2, if the plurality of extension assemblies 380 are used, the plurality of spindle assemblies 360 are configured to slide into the hollow portions of the upper couplers 382 and the lower couplers 384, which, during use, are secured partially within the first and second upper slots 142, 180 and the first and second lower slots 218, 222 and partially within the upper and lower extension housings 388, 390 (see FIG. 8). Therefore, approximately half of each coupler 382, 384 is secured within the slots 142, 180, 218, 222 of the support assembly 104 and the other half of each coupler 382, 384 is secured within the extension passageways 396 of the of the upper and lower extension housings 388, 390. As noted herein, the first upper slot 142, the second upper slot 180, the first lower slot 218, and the second lower slot 222 may comprise a stop therein that limits the upper and lower couplers 382, 384 from sliding too deep within the slots 142, 180, 218, 222. As discussed above, approximately half of each upper and lower coupler 382, 384, should be seen extending outwardly from each of the slots 142, 180, 218, 222 after the upper and lower couplers 382, 384 are slid into the slots 142, 180, 218, 222.

In some embodiments, one of the plurality of extension assemblies 380 can add about 2.75" (7 cm) to the width of the gate assembly 100. In some embodiments, one of the plurality of extension assemblies 380 can add between about 1" (2.5 cm) and about 4" (10 cm) or between about 2" (5 cm) and about 3" (7.6 cm) to the width of the gate assembly 100. In some embodiments, one of the plurality of extension assemblies 380 can add at least 1" (2.5 cm) or at least 2" (5 cm) to the width of the gate assembly 100.

Figure 4:
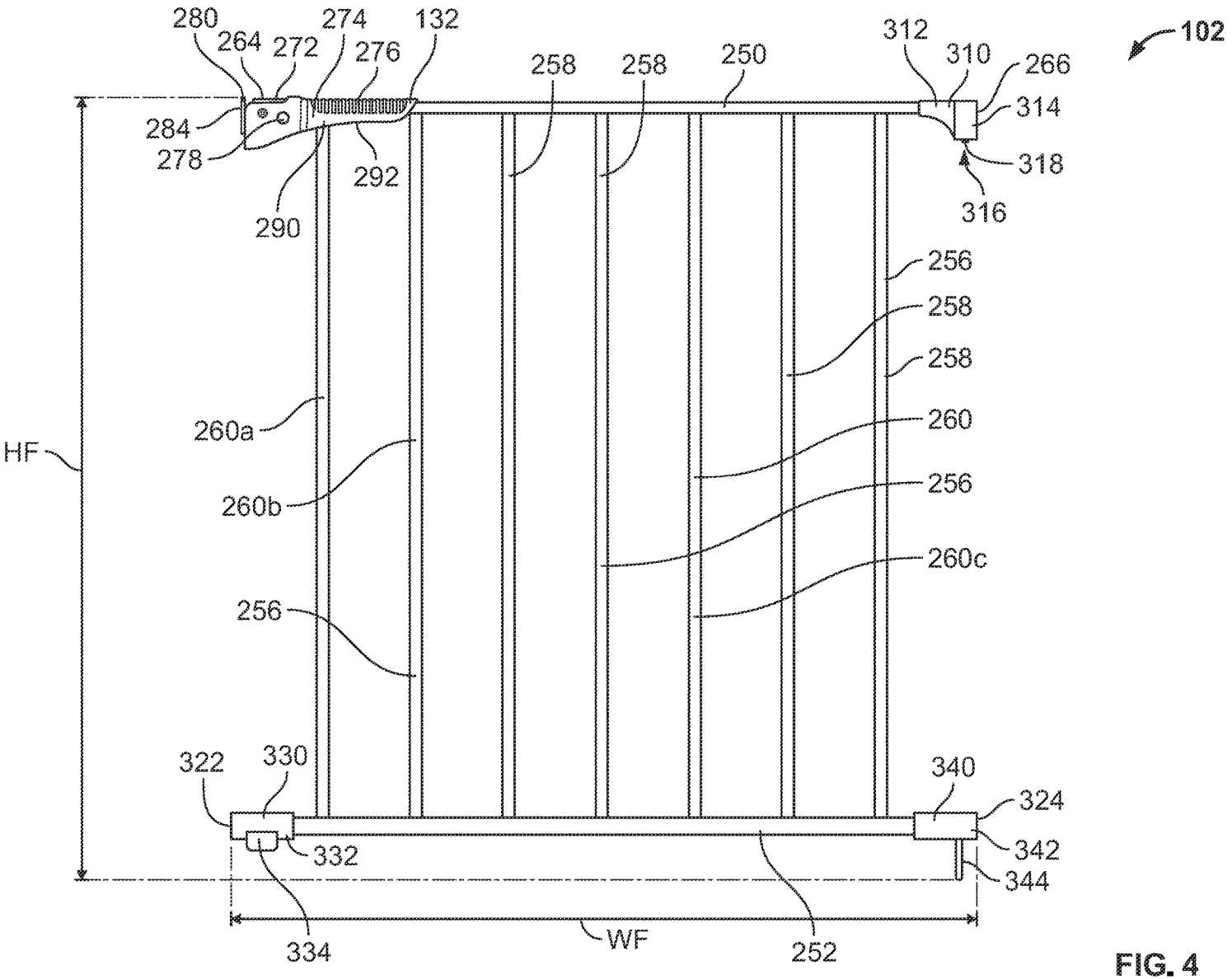
FIG. 4 is a front elevational view of a gate of the knock down gate assembly of FIGS. 1 and 2 in an assembled state.

Referring to FIGS. 1, 3, and 4, a method of assembling the gate assembly 100 will now be described. All of the components illustrated in FIG. 1 should be laid flat along a surface in a similar orientation. In particular, the first support 106 should be aligned with the first flange 206 of the base 110 and the second support 108 should be aligned with the second flange 208 of the base 110. The first support 106 and the second support 108 should be then urged onto the first and second flanges 206, 208 of the base 110, respectively. The first and second flanges 206, 208 are configured to be slidingly retained within the hollow space of the first and second supports 106, 108, respectively. Once the first and second supports 106, 108 are slid onto the first and second flanges 206, 208 of the base 110, the first support aperture 150 of the first support 106 and the first base aperture 152 of the base 110 should be aligned to receive the first support fastener 154. Further, the second support aperture 182 of the second support 108 and the second base aperture 184 of the base 110 should be aligned to receive the second support fastener 186. Once the first support fastener 154 and the second support fastener 186 are secured to the first support 106, the second support 108, and the base 110, the support assembly 104 is assembled.

Referring to FIG. 3, the support assembly 104 is illustrated in an assembled state. As illustrated in FIG. 3, the first support 106 and the second support 108 completely cover the first flange 206 and the second flange 208, respectively. In some embodiments, the first and second supports 106, 108 are orthogonal to the base 110 once assembled, i.e., the first support 106 and the second support 108 are substantially parallel. However, in some embodiments, the first and second supports 106, 108 may comprise an angle greater than 90° with the base 110, i.e., the first support 106 and the second support 108 diverge from one another.

Referring back to FIGS. 1, 2, and 4, during assembly, the upper rail 250 of the gate 102 should be positioned in a parallel fashion with the lower rail 252 of the gate 102 such that the post receiving apertures 254 are aligned. The fastening posts 258 should be aligned within their respective post receiving apertures 254, and the post fasteners 262 may be inserted into fastener apertures 410 along the upper and lower rails 250, 252, although the post fasteners 262 preferably are not tightened at this stage in order to leave sufficient clearance to install the plurality of cylindrical posts 260. The plurality of cylindrical posts 260 are aligned with the respective post receiving apertures 254 in a fashion similar to the configuration shown in FIGS. 1 and 2. Thereafter, the post fasteners 262, which in the present embodiment are machine screws, are either inserted into the fastener apertures 410 and are tightened or already having been inserted into the fastener aperture 410 are simply tightened. Tightening of the post fasteners 262 draws the upper rail 250 and the lower rail 252 closer together, and retains the plurality of cylindrical posts 260 within the post receiving apertures 254.

Referring to FIG. 4, the gate 102 is illustrated in an assembled state. As illustrated in FIG. 4, the plurality of posts 256 are securely fastened to the upper and lower rail 250, 252. In preferred embodiments, the plurality of posts 256 are substantially orthogonal with the upper and lower rails 250, 252. However, in alternative embodiments, the plurality of posts 256 may be slightly angled with respect to the upper and lower rails 250, 252.

Referring to FIG. 5, the gate 102 and the support assembly 104 are shown assembled and in an exploded view. As illustrated in FIGS. 1-5, once the gate 102 and the support assembly 104 are assembled, the gate 102 can be attached to the support assembly 104. In particular, the gate 102 is placed on the support assembly 104 such that the upper pin 318 of the upper pin assembly 310 is aligned with the passageway 168 of the mounting assembly 160, i.e., the mounting sleeve 166 is positioned within the pin chamber 316, and the lower pin 344 of the lower pin assembly 340 is aligned with the gate aperture 224 of the base 110. The upper pin 318 of the upper pin assembly 310 is then urged into the passageway 168 of the mounting assembly 160 and the lower pin 344 of the lower pin assembly 340 is urged into the gate aperture 224 of the base 110 to secure the gate 102 to the support assembly 104. As illustrate in FIG. 6, once the gate 102 and the support assembly 104 are attached, the upper pin assembly 310 is positioned on the ledge 164 of the mounting assembly 160 and the lower pin assembly 340 is positioned on the base 110. As discussed above, the gate 102 is rotatable about the support assembly 104. Specifically, the upper pin 318 and the lower pin 344 create an axis of rotation that the gate 102 can rotate by. Therefore, the upper pin 318 is capable of rotating while positioned within the passageway 168 of the mounting assembly 160 and the lower pin 344 is capable of rotating while positioned within the gate aperture 224 of the base 110. As noted herein, the spring 172, the washer 174, and the mounting fastener 176 may be secured within the mounting assembly 160 before or after the gate 102 is secured to the support assembly 104. Once the gate 102 and the support assembly 104 are assembled, the plurality of spindle assemblies 360 may be secured within the slots 142, 180, 218, 222 of the support assembly 104 and adjusted depending on the width of the opening that the gate assembly 100 is intended to span, as described in greater detail below.

Once the gate 102 and the support assembly 104 are secured together, the gate assembly 100 may be placed in an open or closed position. As noted herein, the open position is defined as any position in which the handle assembly 132 is not attached or secured to the latch assembly 130 on the first support 106 and access through the gate assembly 100 is allowed. Further, the closed position is defined as a position when the handle assembly 132 is secured to the latch assembly 130 on the first support 106 and access through the gate assembly 100 is not allowed. The user should not be able to walk through the support assembly 104 when the gate 102 is in the closed position. In some embodiments, the gate assembly 100 cannot be placed in a closed position until the gate assembly 100 has been secured within the opening. Therefore, in some embodiments, a small gap may exist between the arm 280 of the handle assembly 132 and the latch assembly 130 until the gate assembly 100 is tightly secured within the opening.

Referring now to the steps of installing the gate assembly 100 as shown in FIGS. 1-6, in a preferred embodiment, the gate assembly 100 is installed in a structurally sound opening. In some embodiments, the gate assembly 100 may be secured to a staircase opening. As discussed above, before placing the gate assembly 100 into the opening, the plurality of spindle assemblies 360 should be secured within the support assembly 104. In particular, the threaded portion 364 of the first upper spindle assembly 360*a* should be inserted into the first upper slot 142 of the first upper housing 140, the threaded portion 364 of the second upper spindle assembly 360*c* should be inserted into the second upper slot 180 of the second upper housing 178, the threaded portion 364 of the first lower spindle assembly 360*b* should be inserted into the first lower slot 218 of the first lower housing 216, and the threaded portion 364 of the second lower spindle assembly 360*d* should be inserted into the second lower slot 222 of the second lower housing 220. In some embodiments, the threaded portions 364 of the plurality of spindle assemblies 360 may be fastened within the slots 142, 180, 218, 222. Further, in some embodiments, the threaded portions 364 of the plurality of spindle assemblies 360 may snap fit or slidingly engage with the slots 142, 180, 218, 222 to secure the plurality of spindle assemblies 360 therein. Furthermore, in some embodiments, the threaded portions 364 may be simply inserted within the slots 142, 180, 218, 222 and secured thereto. Once the plurality of spindle assemblies 360 are attached, the gate assembly 100 should be placed within the opening it is intended to occupy. An appropriate width may be achieved by adjusting one or more of the four spindle assemblies 360*a*, 360*b*, 360*c*, 360*d*. Each of the plurality of spindle assemblies 360 is capable of adjustment individually, and may be extended to varying lengths to allow for molding, uneven walls, etc. In particular, the nuts 362 can be rotated along the threaded portions 364 of the plurality of spindle assemblies 360 to increase the length that the plurality of spindle assemblies 360 extend from the support assembly 104. Therefore, the plurality of spindle assemblies 360 should be adjusted until a desired width is achieved. It is preferred that the gate assembly 100 be secured tightly to the opening in order for the gate assembly 100 to achieve optimal performance.

Referring to FIG. 6, the gate assembly 100 is illustrated in an installed state, attached to a door opening in the closed position, i.e., the user cannot walk through the gate assembly 100. As illustrated in FIG. 6, the handle assembly 132 is secured to the latch assembly 130 and the handle sleeve 274 is in the first configuration. With reference to FIGS. 1, 5, and 6, the arm wall 284 of the arm 280 of the handle assembly 132 is positioned against the latch assembly 130 on the first support 106. Specifically, the protrusion 138 on the latch assembly 130 is secured within the groove 288 on the arm wall 284, and the first ribbed surface 136 of the latch assembly 130 is in contact with the second ribbed surface 286 of the arm wall 284 in order to secure the handle assembly 132 to the latch assembly 130. In the first configuration, the arm wall 284 is pressed firmly against the latch assembly 130 in order to apply additional pressure to gate assembly 100 and further lock the gate assembly 100 to the walls of the opening. This additional pressure helps to further secure the support assembly 104 to the opening, causing the gate assembly 100 to be sturdier within the opening. In addition to the handle assembly 132 securing the gate 102 to the support assembly 104, the clamp 334 of the clamp assembly 330 secures the bottom of the gate 102 to the base 110 of the support assembly 104. Further, incremental changes in how far the plurality of spindle assemblies 360 are spaced from the support assembly 104 can be made at any time by adjusting the nuts 362 to increase and/or decrease the tension.

Referring now to FIGS. 1, 5, 6, and 8, in order to open the gate assembly 100, the user should press the buttons 278 on the handle assembly 132 and rotate the handle sleeve 274 of the handle assembly 132 to the second configuration (see FIG. 8). As discussed above, rotation of the handle sleeve 274 causes the arm wall 284 to linearly translate toward or away from the gate 102. Therefore, as the user rotates the handle sleeve 274 to the second configuration, the arm wall 284 of the arm 280 will move away from the latch assembly 130. As illustrated in FIG. 8, the handle sleeve 274 is shown in the second configuration and a gap 432 exists between the arm wall 284 of the arm 280 and the latch assembly 130. Once the handle sleeve 274 is positioned in the second configuration, the user should lift the handle assembly 132, thereby lifting the gate 102, upward in the direction of arrow A and rotate the gate 102 to allow access through the gate assembly 100. It is necessary to lift the gate 102 in order to remove the protrusion 138 of the latch assembly 130 from the groove 288 of the arm wall 284 via the opening at the bottom. Further, lifting the gate 102 allows the clamp 334 to be disconnected from the base 110 of the support assembly 104. In order to close the gate 102, the above steps are reversed such that the gate 102 is rotated to the closed position and the handle assembly 132 is lifted up and onto the protrusion 138 of the latch assembly 130, thereby also allowing the clamp 334 to secure to the base 110. Then, the handle sleeve 274 can be rotated to the first configuration, pressing the arm wall 284 against the latch assembly 130. It is contemplated that the gate assembly 100 can include various closing mechanisms or handles to secure the gate 102 to the support assembly 104 in the closed configuration. In some embodiments, the handle assembly 132 may comprise a sliding tab that locks to gate 102 to the support assembly 104 (see FIG. 13).

Figure 7:
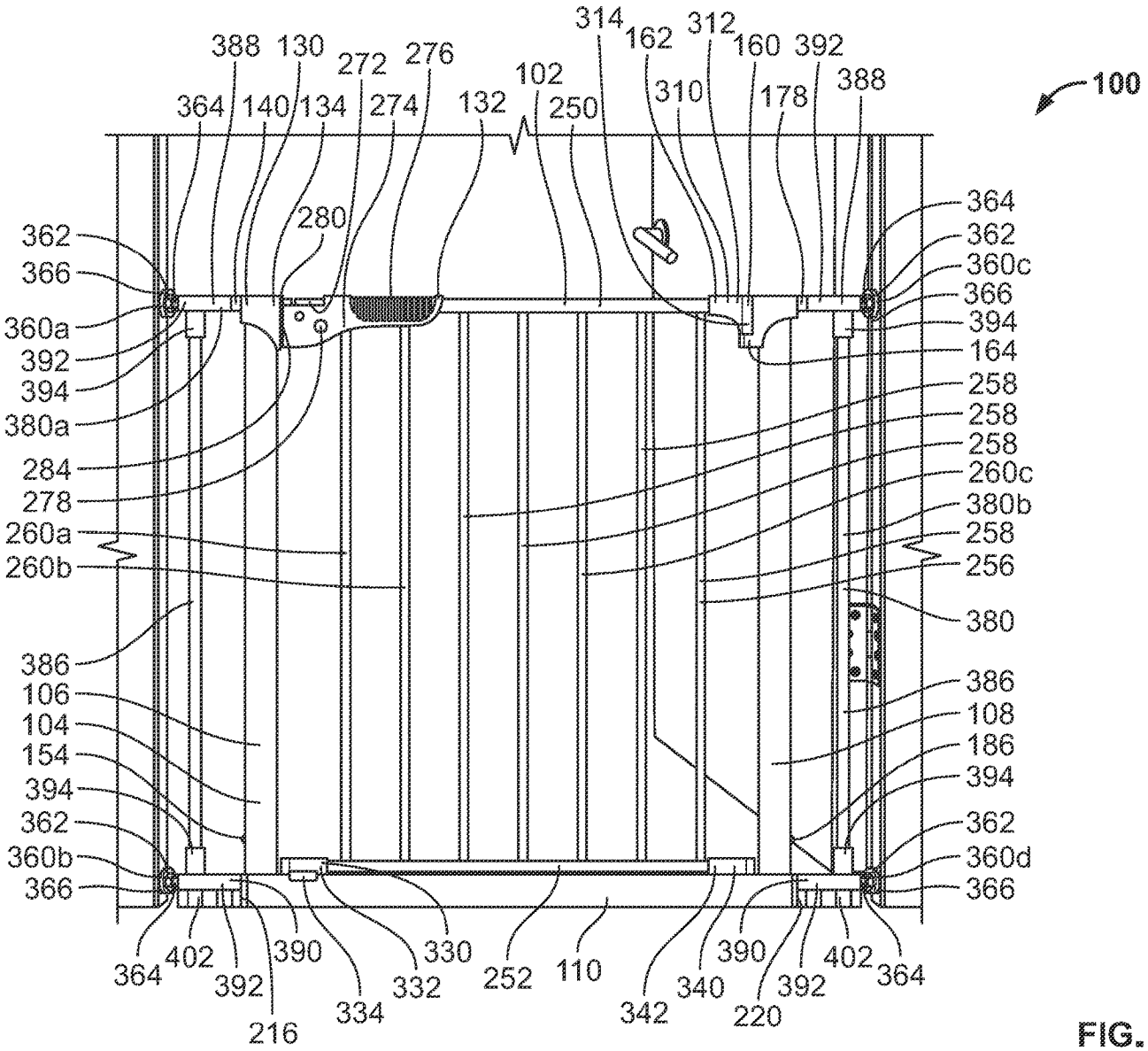
FIG. 7 is a front elevational view of the knock down gate assembly of FIG. 2 in an assembled and installed state.

Referring to FIG. 7, the gate assembly 100 is illustrated with the plurality of extension assemblies 380. In particular, the first extension assembly 380*a* and the second extension assembly 380*b* are secured on respective sides of the gate assembly 100 in order to increase the overall width of the gate assembly 100. Referring to FIGS. 2, 7, and 8, a method of assembling the plurality of extension assemblies 380 to the gate assembly 100 will now be described.

Referring still to FIGS. 2, 7, and 8, once the gate 102 and the support assembly 104 are attached to each other, the plurality of extension assemblies 380 can be attached thereto. In some embodiments, the plurality of extension assemblies 380 can be attached to the support assembly 104 before the gate 102 is attached thereto. As illustrated in FIG. 2, the upper couplers 382 of the extension assemblies 380 should be inserted into the first and second upper slots 142, 180 and the lower couplers 384 of the plurality of extension assemblies 380 should be inserted into the first and second lower slots 218, 222. Once the upper and lower couplers 382, 384 are attached to the support assembly 104, the extension posts 386 should be inserted within the extension passageways 396 of the cylindrical portions 394 of the upper and lower extension housings 388, 390. Once the upper and lower extension housings 388, 390 are secured to the extension posts 386, the upper extension housings 388 should slide over the upper couplers 382 and the lower extension housings 390 should slide over the lower couplers 384 (see FIGS. 7 and 8). After the upper and lower extension housings 388, 390 are secured on the upper and lower couplers 382, 384, the plurality of spindle assemblies 360 should be inserted into the hollow portions of the upper and lower couplers 382, 384, i.e., into the upper and lower extension housings 388, 390 (see FIG. 7). The gate assembly 100 can then be secured to the opening in a similar manner as outlined above, i.e. adjusting the plurality of spindle assemblies 360 to achieve the appropriate width. As discussed above, in some embodiments, multiple extension assemblies 380 may be attached to both sides or one side of the support assembly 104. Further, in some embodiments, an additional gate or a full gate panel may be secured to the sides of the support assembly 104 instead of the extension assemblies 380 (see FIGS. 10-13).

Figure 9:
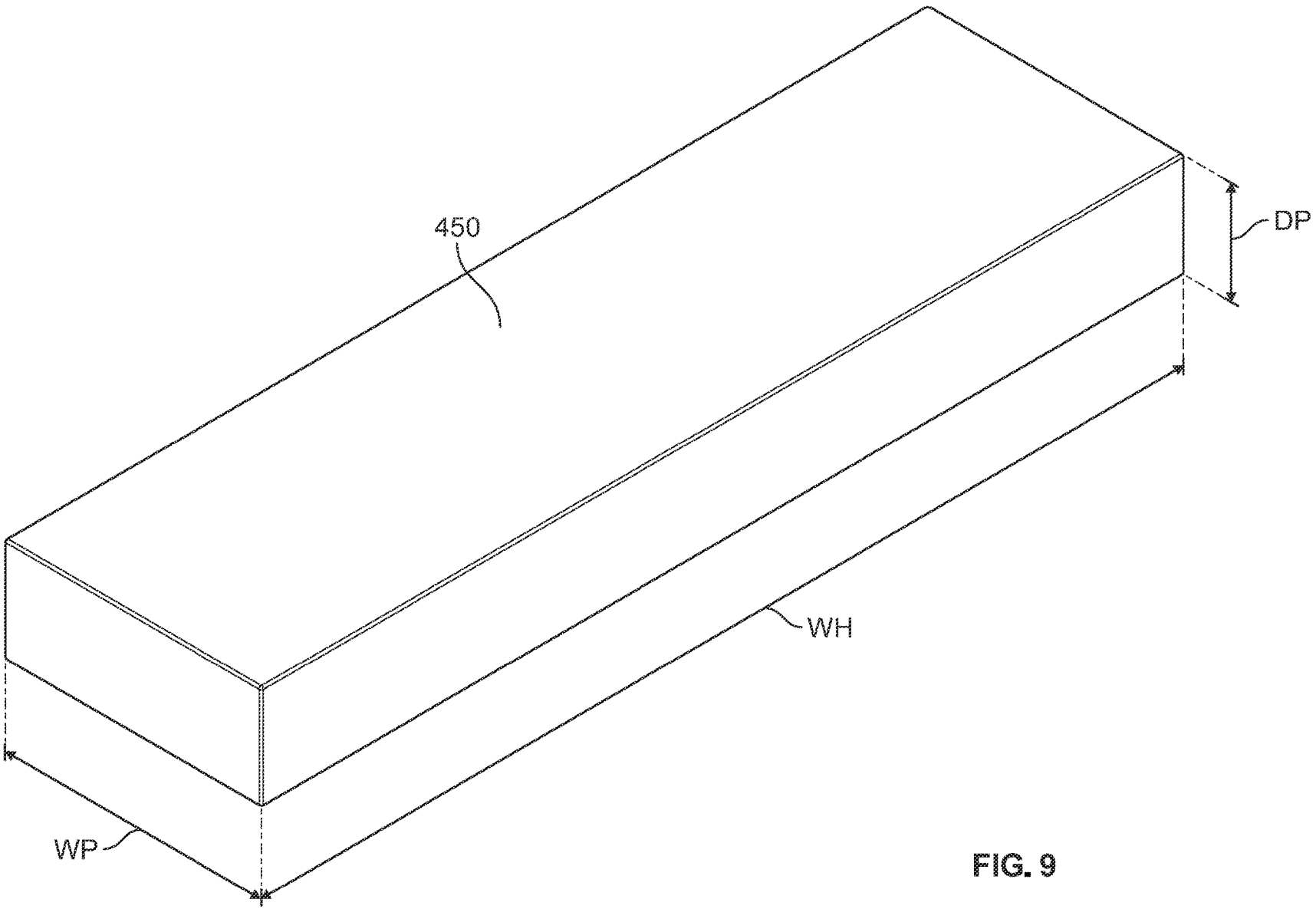
FIG. 9 is a perspective view of a shipping container according to a kit of the present disclosure.

Referring to FIG. 9, traditional gates are welded together and shipped in large rectangular boxes, with the fully assembled gate assembly therein. By volume, the contents of such packages are primarily empty space due to the area between posts. It surprisingly was found that a new packaging 450 significantly improves issues associated with transit, including space constraints and shipping costs, as well as issues surrounding the use of valuable shelf space at the retail level. The traditional or old package for the gate assembly 100 has dimensions that are approximately 22"×28.75"×1.75" (56 cm×73 cm×4 cm). The new packaging 450 of the concept disclosed herein, i.e., the gate assembly 100, has dimensions of approximately 6.75"×29.5"×3.25" (17 cm×75 cm×8 cm). Thus, for every 4 gates packed in old packaging, approximately 6 disassembled gates may be packed in new packaging 450 and take up approximately the same volume in a shipping container, on a store shelf, etc. Additionally, it was found that shipping costs for both the old packaging and new packaging 450 may be based on a formula involving a volumetric calculation component, whereby the reduced volume of the new packaging 450 may reduce that volumetric calculation component by approximately an order of magnitude, significantly reducing per unit shipping costs. Therefore, by shipping the gate assembly 100 disassembled, substantial cost savings can be achieved.

Still referring to FIG. 9, the new packaging 450 is designed to efficiently hold the gate assembly 100 therein. Therefore, the new packaging 450 is designed to hold the gate assembly 100 when it is disassembled, i.e., in a state similar to FIG. 1. Once disassembled, all of the components of the gate assembly 100 can be bundled together and put in the new packaging 450. In some embodiments, the first support 106, the second support 108, the base 110, the upper rail 250, the lower rail 252, and the plurality of posts 256 may be configured to extend substantially parallel to each other in the new packaging 450. As noted herein, the new packaging 450 may define a kit for the knock down gate assembly 100.

Still referring to FIG. 9, the new packaging 450 defines a width of the packaging WP, a height of the packaging HP, and a depth of the packaging DP. Referring to FIG. 6, the gate assembly 100, when fully assembled and installed, defines a width of the gate assembly WG, a height of the gate assembly HG, and a depth of the gate assembly DG (see FIG. 5). Still further, referring to FIG. 4, the gate 102 defines a width of the gate WF, a height of the gate HF, and a depth of the gate DF (see FIG. 5).

The width of the packaging WP may be a first packaging dimension, the height of the packaging HP may be a second packaging dimension, and the depth of the packaging DP may be a third packaging dimension. The width of the gate WF may be a first gate dimension, the height of the gate HF may be a second gate dimension, and the depth of the gate DF may be a third gate dimension. The width of the gate assembly WG may be a first gate assembly dimension, the height of the gate assembly HG may be a second gate assembly dimension, and the depth of the gate assembly DG may be a third gate assembly dimension. In some embodiments, the first packaging dimension is less than the respective first gate assembly dimension, as shown in the Figures. The first, second, and third dimensions of the new packaging 450, gate 102, and/or gate assembly 100 may be rearranged, and need not be limited to the specific structure recited above.

In some embodiments, the new packaging 450 has at least one dimension, i.e., the width of the packaging WP, the height of the packaging HP, or the depth of the packaging DP, that is less than at least one respective dimension of the gate assembly 100, i.e., the width of the gate assembly WG, the height of the gate assembly HG, or the depth of the gate assembly DG. In some embodiments, at least two of the plurality of packing dimensions, i.e., the width of the packaging WP, the height of the packaging HP, or the depth of the packaging DP, are smaller than at least two of the corresponding gate assembly dimensions, i.e., the width of the gate assembly WG, the height of the gate assembly HG, or the depth of the gate assembly DG. Further, in some embodiments, the width of the packaging WP is between about 5% and about 70% of the width of the gate assembly WG, or between about 10% and about 60% of the width of the gate assembly WG, or between about 15% and about 50% of the width of the gate assembly WG. In some embodiments, the width of the packaging WP is less than about 70% of the width of the gate assembly WG, or less than about 60% of the width of the gate assembly WG, or less than about 50% of the width of the gate assembly WG, or less than about 40% of the width of the gate assembly WG, or less than about 30% of the width of the gate assembly WG, or less than about 20% of the width of the gate assembly WG, or less than about 10% of the width of the gate assembly WG. In some embodiments, the width of the packaging WP is about 10% of the width of the gate assembly WG. In some embodiments, the width of the packaging WP is about 20% of the width of the gate assembly WG. In some embodiments, the width of the packaging WP is about 25% of the width of the gate assembly WG. While the widths, heights, and depths of the new packaging 450 and the gate assembly 100 are specifically referred to in the figures, the dimensions may be re-organized, such that the width, height, and/or depth comprise different dimensions than those shown in the Figures.

Still further, in some embodiments, the new packaging 450 has at least one dimension, i.e., the width WP, the height of the packaging HP, or the depth of the packaging DP, that is less than at least one respective dimension of the gate 102, i.e., the width of the gate WF, the height of the gate HF, or the depth of the gate DF. In some embodiments, at least two of the plurality of packing dimensions, i.e., the width of the packaging WP, the height of the packaging HP, or the depth of the packaging DP, are smaller than at least two of the corresponding gate dimensions, i.e., the width of the gate WF, the height of the gate HF, or the depth of the gate DF. Further, in some embodiments, the width of the packaging WP is between about 5% and about 70% of the width of the gate WF, or between about 10% and about 60% of the width of the gate WF, or between about 15% and about 50% of the width of the gate WF. In some embodiments, the width of the packaging WP is less than about 70% of the width of the gate WF, or less than about 60% of the width of the gate WF, or less than about 50% of the width of the gate WF, or less than about 40% of the width of the gate WF, or less than about 30% of the width of the gate WF, or less than about 20% of the width of the gate WF, or less than about 10% of the width of the gate WF. In some embodiments, the width of the packaging WP is about 10% of the width of the gate WF. In some embodiments, the width of the packaging WP is about 20% of the width of the gate WF. In some embodiments, the width of the packaging WP is about 30% of the width of the gate WF. While the widths, heights, and depths of the new packaging 450 and the gate 102 are specifically referred to in the figures, the dimensions may be re-organized, such that the width, height, and/or depth comprise different dimensions than those shown in the Figures.

In some embodiments, the width of the gate assembly WG is between about 15" (38 cm) and about 72" (183 cm), or about 20" (51 cm) and about 35" (89 cm), or about 25" (64 cm) and about 30" (76 cm), or about 28" (71 cm), or at least 15" (38 cm), or at least 20" (51 cm), or at least 25" (64 cm), or at least 28" (71 cm). In some embodiments, the height of the gate assembly HG is between about 15" (38 cm) and about 72" (183 cm), or about 15" (38 cm) and about 50" (127 cm), or about 25" (64 cm) and about 35" (89 cm), or about 29.5" (75 cm), or at least 15" (38 cm), or at least 25" (64 cm), or at least 29.5" (75 cm). In some embodiments, the width of the gate WF is between about 10" (25 cm) and about 72" (183 cm), or about 20" (51 cm) and about 35" (89 cm), or about 22.25" (57 cm), or at least 20" (51 cm), or at least 22.25" (57 cm). In some embodiments, the height of the gate HF is between about 10" (25 cm) and about 72" (183 cm), or about 20" (51 cm) and about 30" (76 cm), or about 28.25" (72 cm), or at least 20" (51 cm), or at least 28.25" (72 cm).

By designing a kit including the various disassembled components described herein and the new packaging 450 for retaining those components, a gate assembly 100 that can be set up on site quickly and with relatively simple assembly, with a reduced shipping and storage profile, and with reduced shipping costs is provided.

Figure 10:
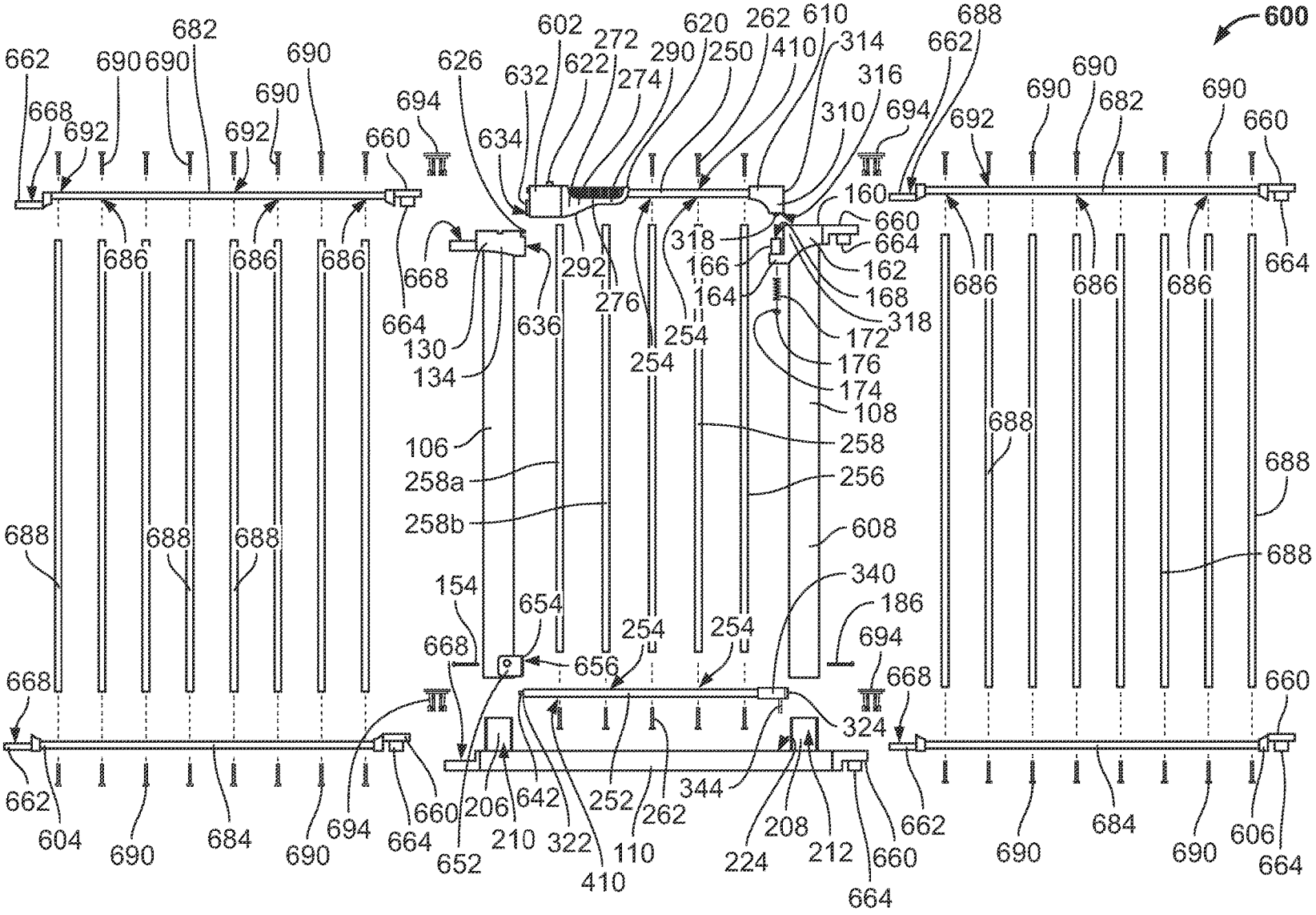
FIG. 10 is a front elevational view of another embodiment of a knock down gate assembly that is shown in a disassembled state.

Referring now to FIGS. 10-13, like reference numbers are used with regard to an alternative embodiment of a knock down gate assembly 600. As noted herein, the gate assembly 600 is similar to the gate assembly 100 except for a few differences, which will be explained in detail below. As illustrated in FIG. 10, the gate assembly 600 is shown in a disassembled state. Similar to the gate assembly 100, the gate assembly 600 can be shipped to the user disassembled and then put together for use. The gate assembly 600 is also formed from steel; however, it is contemplated that the gate assembly 600 can be formed from any type of metal, metal alloy, plastic, wood, combinations thereof, or an alternative material, similar to the gate assembly 100.

Referring to FIG. 10, the gate assembly 600 comprises a main panel 602 and one or more of a first auxiliary panel 604 and a second auxiliary panel 606. As noted herein, the main panel 602 is similar to the gate assembly 100 described above. In particular, the main panel 602 comprises a support assembly 608 and a gate 610. As illustrated in FIG. 10, the gate 610 comprises five fastening posts 258 secured to the upper rail 250 and the lower rail 252 and the gate 610 does not comprise any of the cylindrical posts 260. Therefore, all of the fastening posts 258 are secured by the post fasteners 262 except for the two leftmost fastening posts 258*a*, 258*b* on the gate 610 (reference specifically to FIG. 10). Instead, the upper ends of the two leftmost fastening posts 258*a*, 258*b* are snuggly fit within the post receiving apertures 254 in the upper rail 250. Since the upper rail 250 comprises an opening mechanism or handle assembly 620, the post fasteners 262 cannot extend therethrough. Therefore, the upper ends of the two leftmost fastening posts 258*a*, 258*b* on the gate 610 act in a similar manner as the cylindrical posts 260 described above. It is noted that the lower ends of the two leftmost fastening posts 258*a*, 258*b* are secured to the lower rail 252 by the post fasteners 262, similar as described above.

Figure 11:
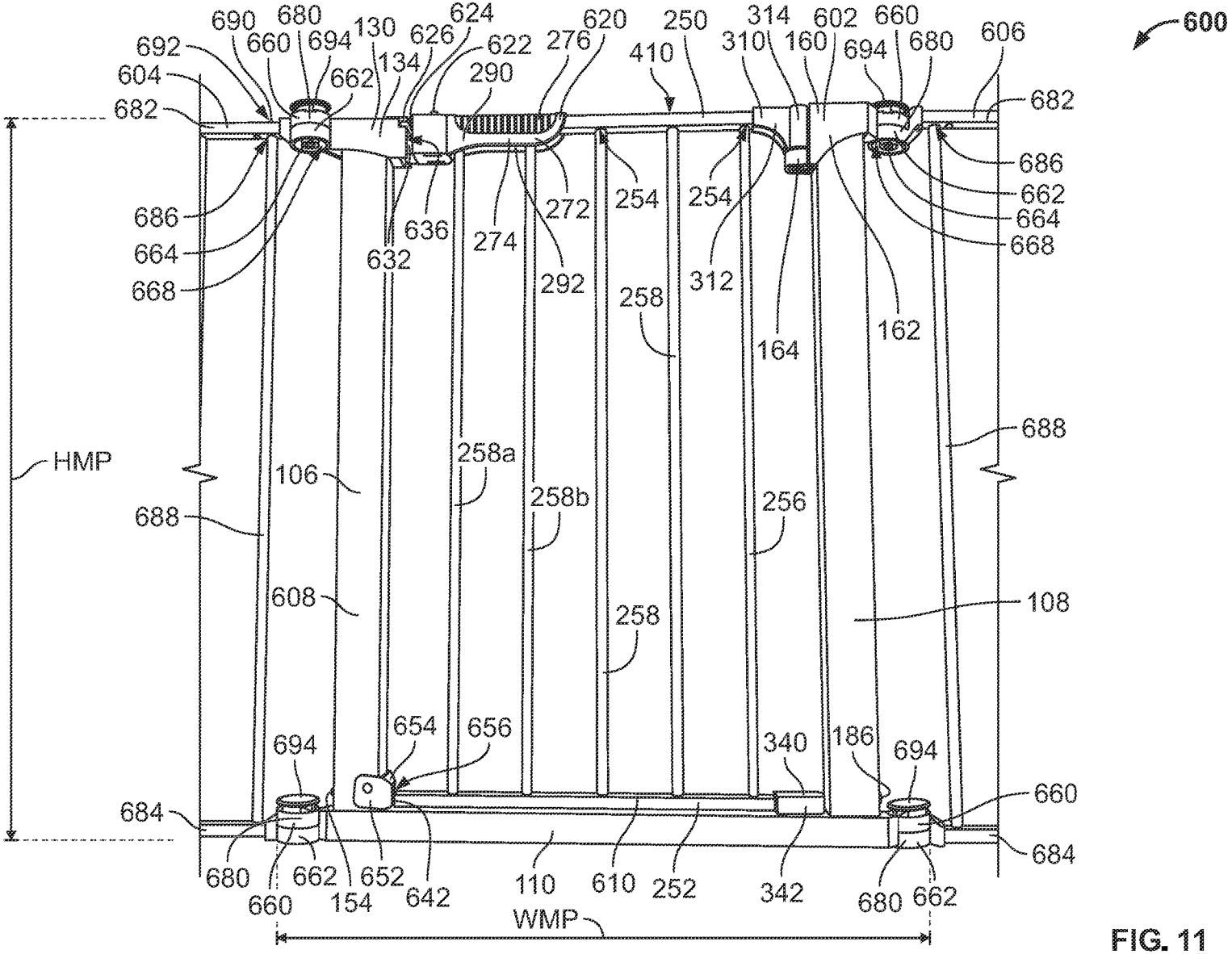
FIG. 11 is a zoomed in view of a main panel of the knock down gate assembly of FIG. 10 in an assembled state.

Referring to FIG. 11, a zoomed in view of the main panel 602 is illustrated in assembled state. Similar to the handle assembly 132 in FIGS. 1-8, the handle assembly 620 is positioned on the first upper rail end 264 of the upper rail 250. As illustrated in FIGS. 11 and 13, the handle sleeve 274 of the handle assembly 620 is not configured to rotate. Instead, the handle assembly 620 comprises a sliding tab 622 that is secured to a latch 624 (see FIG. 12). The latch 624 of the handle assembly 620 is configured to interact with a catch 626 on the latch assembly 130 of the first support 106 to secure the gate 610 to the support assembly 608. In some embodiments, the sliding tab 622 and the latch 624 may be biased to a closed position (see FIG. 12) by an internal spring (not shown). Therefore, the sliding tab 622 and the latch 624 can always be in the closed position and require a force to move into the open position to remove the latch 624 from the catch 626 (see FIG. 13). The handle assembly 620 also comprises a magnet 632 positioned in a magnet cavity 634 below the latch 624. The magnet 632 is configured to interact with a locking cavity 636 in the latch assembly 130 to further secure the handle assembly 620 to the latch assembly 130. In particular, in the closed position, the magnet 632 is attracted to the metal within the locking cavity 636 and slides therein. Put differently, in the closed position, the magnet 632 partially extends outwardly from the magnet cavity 634 and into the locking cavity 636 in the latch assembly 130 (by way of magnetic forces). This allows the handle assembly 620 to be locked in placed to the latch assembly 130.

Referring to FIGS. 11 and 13, the lower rail 252 of the gate 610 does not comprise the clamp assembly 330. Instead, the lower rail 252 of the gate 610 comprises a gate pin 642 that extends from the first lower rail end 322 of the lower rail 252. The gate pin 642 is resiliently positioned on the first lower rail end 322 of the lower rail 252. In particular, the gate pin 642 is secured within the lower rail 252 by a spring (not shown) that keeps the gate pin 642 in an extended state. Therefore, the gate pin 642 is configured to move into the lower rail 252 when a force is applied to it. Once the force subsides, the gate pin 642 is configured to pop back out of the lower rail 252 to the positions shown in FIG. 13. As will be described in more detail below, the gate pin 642 is configured to secure the lower end of the gate 610 to the support assembly 608.

Referring still to FIGS. 11 and 13, the support assembly 608 of the gate assembly 600 is substantially similar to the support assembly 104 of the gate assembly 100. In addition to the differences in the latch assembly 130, as discussed above, the first support 106 of the support assembly 608 also comprises a bracket 652 near the first lower end 114 of the first support 106. The bracket 652 comprises a general U-shape and is fastened to the first support 106. The bracket 652 also comprises an outer chamfered wall 654 and a bracket cavity 656. The outer chamfered wall 654 is positioned on an upper portion of the bracket 652 and the bracket cavity 656 is positioned directly below the outer chamfered wall 654. The bracket cavity 656 comprises a generally elongated shape and an inner chamfered wall (not shown) at a top end of the bracket cavity 656. The bracket cavity 656 is configured to receive the gate pin 642 when the gate 610 is in the closed position. The outer chamfered wall 654 and the inner chamfered wall (not shown) are configured to move the gate pin 642 into the lower rail 252 in order for the gate pin 642 to be inserted and removed from the bracket cavity 656. Once the gate pin 642 is secured within the bracket cavity 656 of the bracket 652, the lower rail 252 of the gate 610 is secured to the first support 106.

Referring to FIG. 11, the support assembly 608 of the main panel 602 of the gate assembly 600 also comprises a plurality of upper hinges 660 and a plurality of lower hinges 662 positioned on the corners of the support assembly 608. Specifically, the latch assembly 130 and the first end 202 of the base 110 comprise the lower hinges 662, and the mounting assembly 160 and the second end 204 of the base 110 comprise the upper hinges 662. The plurality of upper hinges 660 comprise a rod 664 extending downwardly from the plurality of upper hinges 660, and the plurality of lower hinges 662 comprise a hinge aperture 668 therein (see FIG. 10). As discussed above, the plurality of upper hinges 660 and the plurality of lower hinges 662 are positioned at the corners of the main panel 602 and are configured to interact with other upper and lower hinges 660, 662 to secure the main panel 602 to the first auxiliary panel 604 and the second auxiliary panel 606. Therefore, the plurality of lower hinges 662 on the main panel 602 will attach with corresponding upper hinges 660 on the first auxiliary panel 604 and the plurality of upper hinges 660 on the main panel 602 will attach with corresponding lower hinges 662 on the second auxiliary panel 606. The attachment of the upper and lower hinges 660, 662 create a joint 680. As will be described in more detail below, each of the first auxiliary panel 604 and the second auxiliary panel 606 also comprise the plurality of upper hinges 660 and the plurality of lower hinges 662.

Referring to FIG. 10, the first auxiliary panel 604 and the second auxiliary panel 606 are shown next to the main panel 602. While the present embodiment includes two auxiliary panels 604, 606, the same reference numbers apply to like elements of each auxiliary panel 604, 606 as described hereinafter below. As such, only one auxiliary panel, i.e., the first auxiliary panel 604, is described and referred to herein, however, the auxiliary panels 604, 606 are identical, and the description of one relates to the description of the other. As illustrated in FIG. 10, the first auxiliary panel 604 comprises an auxiliary upper rail 682 and an auxiliary lower rail 684. The auxiliary upper rail 682 and the auxiliary lower rail 684 are disposed at opposing ends of the first auxiliary panel 604, and each includes a plurality of auxiliary post receiving apertures 686. The plurality of auxiliary post receiving apertures 686 are sized and shaped to receive ends of a plurality of auxiliary posts 688, which are generally disposed orthogonally with respect to the auxiliary upper rail 682 and the auxiliary lower rail 684. As noted herein, the plurality of auxiliary posts 688 function in the same way as the plurality of fastening posts 258 described above. In particular, a plurality of auxiliary post fasteners 690 may be inserted into the auxiliary upper rail 682 and the auxiliary lower rail 684, and engage with the plurality of auxiliary posts 688, similarly as described below with respect to the post fasteners 262 and the plurality of fastening posts 258. In some embodiments, some of the plurality of auxiliary posts 688 may not be attached to the auxiliary upper rail 682 and/or the auxiliary lower rail 684. Instead, one or more of the plurality of auxiliary posts 688 may be screwed or just inserted into the auxiliary upper rail 682 and/or the auxiliary lower rail 684 in a similar way as the plurality of cylindrical posts 260 described above.

Referring still to FIG. 10, the auxiliary upper rail 682 comprises the upper hinge 660 on one side of the first auxiliary panel 604 and the lower hinge 662 on the other side of the auxiliary upper rail 682. Similarly, the auxiliary lower rail 684 comprises the upper hinge 660 on one side of the auxiliary lower rail 684 and the lower hinge 662 on the other side of the auxiliary lower rail 684. As discussed above, the hinges 660, 662 on the first auxiliary panel 604 are the same as the ones on the main panel 602. Therefore, the plurality of upper hinges 660 on the first auxiliary panel 604 are secured with the plurality of lower hinges 662 on the main panel 602 to create the joints 680.

Referring to FIGS. 10 and 11, a method of assembling the gate assembly 600 will now be described. As noted herein, the main panel 602 is configured to be assembled in the same way as the gate assembly 100. In particular, the first support 106 and the second support 108 are secured to the first and second flanges 206, 208 of the base 110, and the plurality of fastening posts 258 are securely fastened to the upper rail 250 and the lower rail 252 by the plurality of post fasteners 262. Once the gate 610 and the support assembly 608 are assembled, they are attached to each other in a similar fashion as outlined above with respect to the gate assembly 100, i.e., the upper pin assembly 310 secures to the mounting assembly 160 and the lower pin assembly 340 secures to the base 110.

Referring still to FIGS. 10 and 11, during assembly, the auxiliary upper rail 682 of the first auxiliary panel 604 should be positioned in a parallel fashion with the auxiliary lower rail 684 of the first auxiliary panel 604 such that the auxiliary post receiving apertures 686 are aligned. The plurality of auxiliary posts 688 should be aligned within their respective auxiliary post receiving apertures 686, and the auxiliary post fasteners 690 may be inserted into auxiliary fastener apertures 692 along the auxiliary upper and lower rails 682, 684. The plurality of auxiliary posts 688 are aligned with their respective auxiliary post receiving apertures 686 in a fashion similar to the configuration shown in FIG. 10. Thereafter, the auxiliary post fasteners 690, which in the present embodiment are machine screws, are inserted into the auxiliary fastener apertures 692 and are tightened. Tightening of the auxiliary post fasteners 690 draws the auxiliary upper rail 682 and the auxiliary lower rail 684 closer together. As noted herein, the second auxiliary panel 606 is assembled in a similar way as the auxiliary first panel 604 described above. Further, in preferred embodiments, the main panel 602, the first auxiliary panel 604, and the second auxiliary panel 606 may be formed/assembled separately and then attached thereafter. However, in some embodiments, the main panel 602, the first auxiliary panel 604, and the second auxiliary panel 606 may be formed and installed together.

Referring still to FIGS. 10 and 11, once the main panel 602, the first auxiliary panel 604, and the second auxiliary panel 606 are assembled, the main panel 602 may be secured to the first auxiliary panel 604 and the second auxiliary panel 606. In particular, the plurality of upper hinges 660 on the first auxiliary panel 604 are secured to the plurality of lower hinges 662 on the main panel 602 and the plurality of upper hinges 660 on the main panel are secured to the plurality of lower hinges 662 on the second auxiliary panel 606. As illustrated in FIGS. 10 and 11, the rods 664 of the plurality of upper hinges 660 are urged through the hinge apertures 668 of the plurality of lower hinges 662 to form the joints 680. Once the plurality of upper hinges 660 are secured on the plurality of lower hinges 662, a joint coupler 694 is inserted into the upper and lower hinges 660, 662. As will be discussed in further detail below, the joint coupler 694 is configured to lock the joint 680 in place once it is fully urged into the upper and lower hinges 660, 662.

Figure 12:
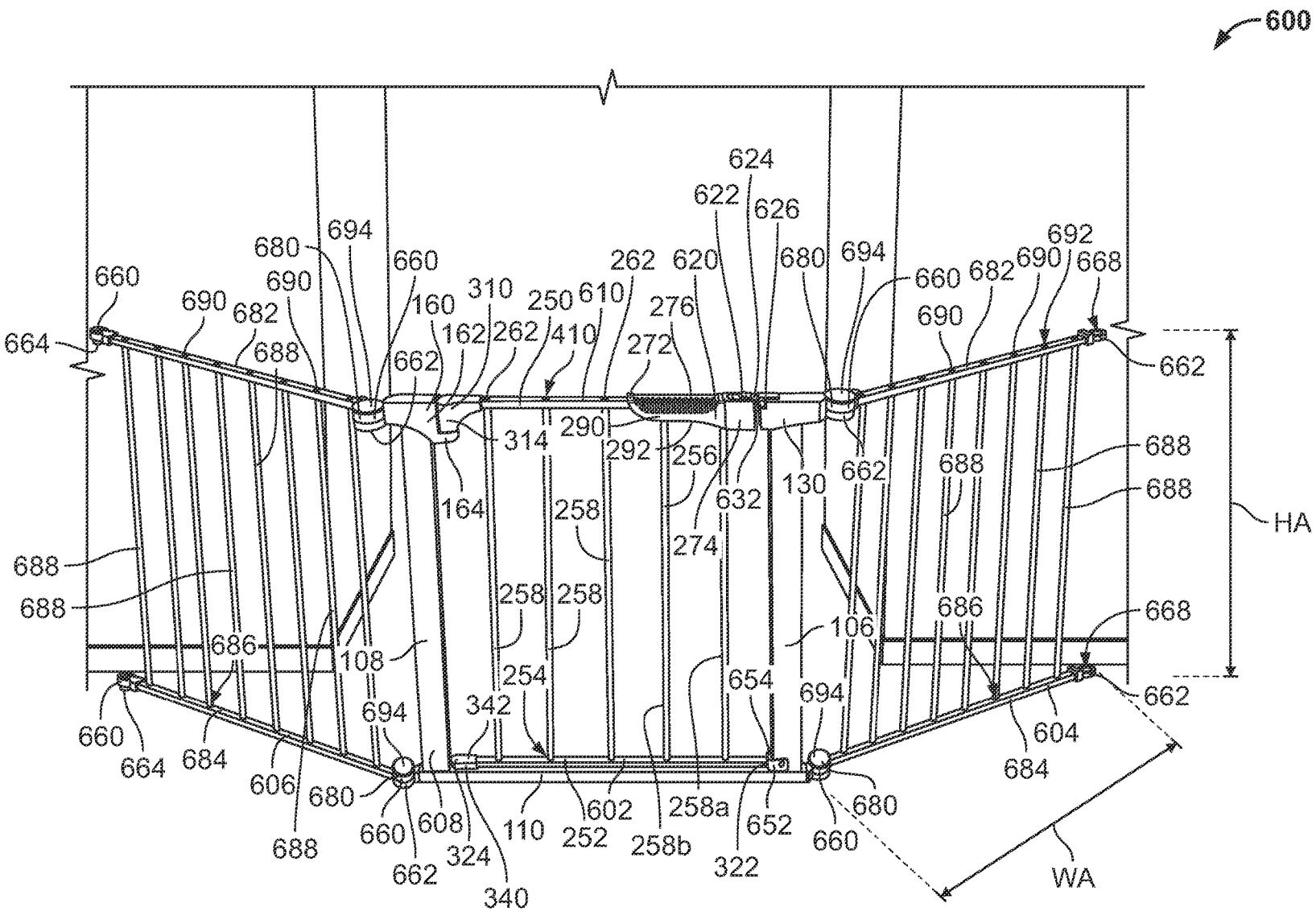
FIG. 12 is a perspective rear view of the knock down gate assembly of FIG. 10 in an assembled and installed state.
Figure 13:
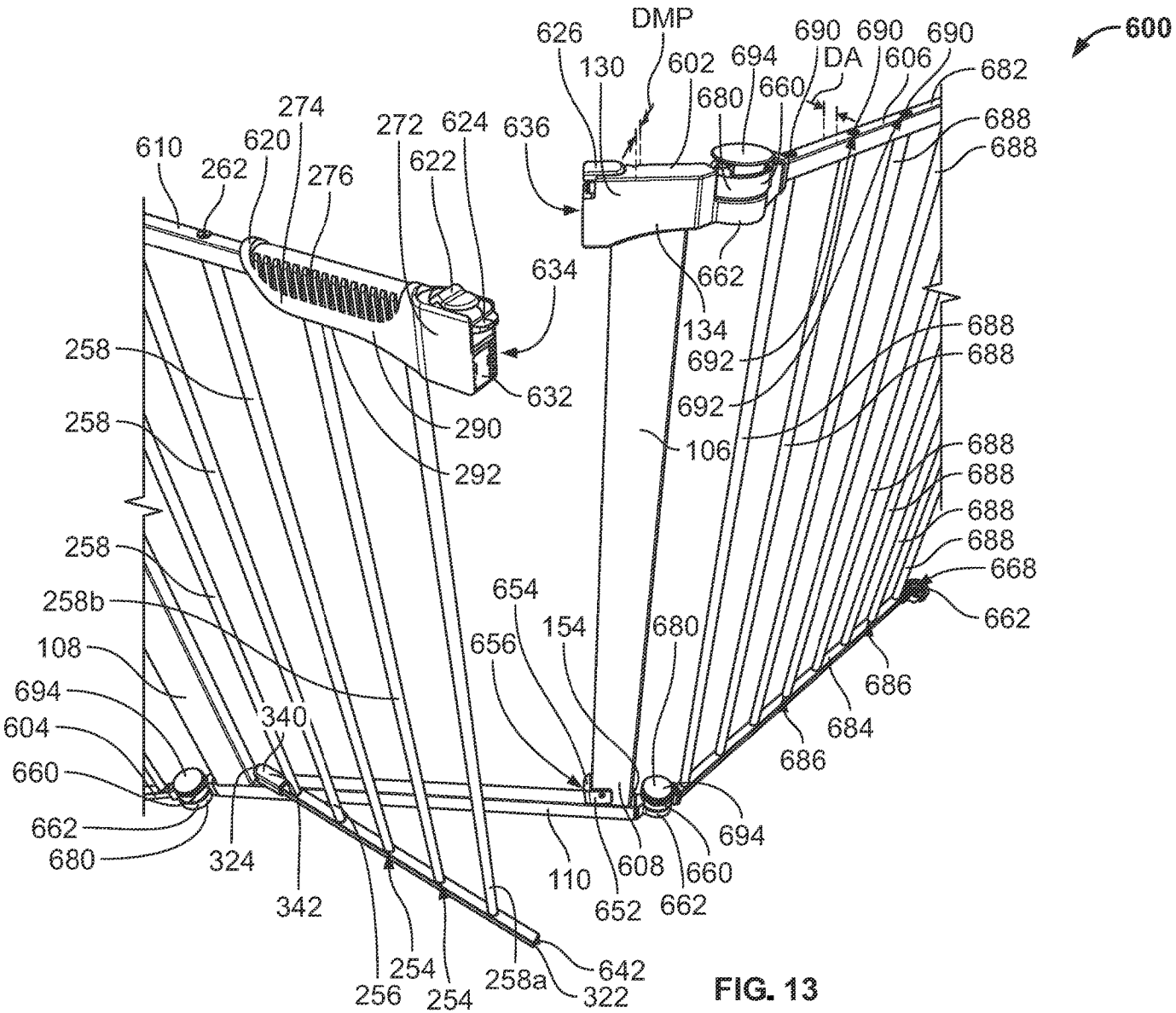
FIG. 13 is a perspective rear view of the knock down gate assembly of FIG. 10 in an open configuration.

Referring to FIG. 12, the gate assembly 600 is illustrated in an assembled state and installed configuration. As illustrated in FIG. 12, the first and second auxiliary panels 604, 606 are attached to the main panel 602. As noted herein, the gate assembly 600 is configured to be used in large doorways, hallways, or staircases and can comprise additional auxiliary panels 604, 606. For example, the gate assembly can include 3, 4, 5, 6, 7, 8, 9, or more auxiliary panels 604, 606 all attached to the main panel 602. In some embodiments, the gate assembly 600 may include more than one main panel 602 with the gate 610 therein. Once the first and second auxiliary panels 604, 606 are secured to the main panel 602, a user may adjust and/or rotate the first and second auxiliary panels 604, 606 with respect to the main panel 602. In particular, the gate assembly 600 is rotatable about the joints 680. In some embodiments, the joints 680 allow the first and second auxiliary panels 604, 606 to rotate about 360°. As discussed above, the joint couplers 694 allow and stop the rotation of the joints 680. Specifically, if the user would like to rearrange the gate assembly 600 or move the first and second auxiliary panels 604, 606 to a new configuration, the user can lift the joint couplers 694 up such that they are in an up position (see FIGS. 11 and 13). Once the joint couplers 694 are in an up position, the first and second auxiliary panels 604, 606 can rotate freely about the main panel 602. Once the desired positioning is reached, the user can urge the joint couplers 694 downwardly to lock the joints 680 in place, i.e., the first and second auxiliary panels 604, 606 cannot rotate about the main panel 602 once the joint couplers 694 are placed in a down position (see FIG. 12). Therefore, the joint couplers 694 allow the gate assembly 600 to be locked in place and not move or rotate while the gate assembly 600 is attached to the wall.

Although not illustrated, in preferred embodiments, the first auxiliary panel 604 and/or the second auxiliary panel 606 may be attached to, secured to, or mounted to a wall or doorway. Specifically, the upper and lower hinges 660, 662 that are not attached to the main panel 602 may be secured to a wall mount or device to secure the gate assembly 600 to the wall or opening. It is contemplated that the first and second auxiliary panels 604, 606 may be secured and/or mounted to a wall in any conventional manner.

Referring to FIG. 12, the gate assembly 600 is shown in a closed configuration, i.e., access through the gate is now allowed. In order to open the gate 610, the sliding tab 622 should be slid away from the latch assembly 130, i.e., to the open position, in order to disengage the latch 624 of the handle assembly 620 with the catch 626, and the gate 610 should be lifted up from the ground or floor. As the gate 610 is lifted upwards and the latch 624 is disassembled from the catch 626, the magnet 632 will be pulled out of the locking cavity 636 and retract back into the magnet cavity 634 (see FIG. 13). Further, as the gate 610 is lifted upwards, the gate pin 642 will retract into the first lower rail end 322 of the lower rail 252 as it slides along the inner chamfered wall (not shown) inside the bracket cavity 656 (see FIG. 11). Once the gate 610 is lifted, the gate 610 can be rotated to an open position such that access through the gate 610 is allowed. In order to close the gate 610, the above steps are reversed such that the gate 610 is rotated to the closed position and lifted up and onto the support assembly 608. In particular, the gate pin 642 will retract again as it extends along the outer chamfered wall 654 of the bracket 652 and secure within the bracket cavity 656. Further, as the gate 610 is dropped into place, the sliding tab 622 should be slid away from the latch assembly 130 in order for the gate 610 to fall into place. Once the gate 610 is in a closed position and the gate pin 642 is secured within the bracket cavity 656, the sliding tab 622 can be let go of and the latch 624 will automatically engage with the catch 626. Further, the magnet 632 will automatically extend into the locking cavity 636 to secure the handle assembly 620 to the latch assembly 130.

Referring to FIGS. 10-13, the gate assembly 600 can be shipped and/or arranged in a package (or kit) similar to the new packaging 450 described above with respect to the gate assembly 100. Therefore, the gate assembly 600 defines similar dimensions as described above with respect to the gate assembly 100, e.g., the width of the packaging WP being a first packaging dimension, the height of the packaging HP being a second packaging dimension, and the depth of the packaging DP being a third packaging dimension. As noted herein, the entire gate assembly 600, i.e., the main panel 602, the first auxiliary panel 604, and the second auxiliary panel 606, can fit into a single package, similar to the new packaging 450 discussed above. The traditional or old package for the gate assembly 600 has dimensions that are approximately 32"×33"×4.25" (81 cm×84 cm×11 cm). The new packaging 450 for the gate assembly 600 has dimensions of approximately 10"×30"×6" (25 cm×76 cm×15 cm).

Referring to FIG. 11, the main panel 602, when fully assembled, defines a width of the main panel WMP, a height of the main panel HMP, and a depth of the main panel DMP (see FIG. 13). Further, referring to FIG. 1, the first auxiliary panel 604 defines a width of the auxiliary panel WA, a height of the auxiliary panel HA, and a depth of the auxiliary panel DA (see FIG. 13). As noted herein, the second auxiliary panel 606 comprises the same dimensions as the first auxiliary panel 604.

The width of the main panel WMP may be a first main panel dimension, the height of the main panel HMP may be a second main panel dimension, and the depth of the gate DMP may be a third main panel dimension. The width of the auxiliary panel WA may be a first auxiliary panel dimension, the height of the auxiliary panel HA may be a second auxiliary panel dimension, and the depth of the auxiliary panel DA may be a third auxiliary panel dimension. In some embodiments, the first packaging dimension is less than the respective first main panel dimension, as shown in the Figures. The first, second, and third dimensions of the packaging, main panel, and/or auxiliary panel may be rearranged, and need not be limited to the specific structure recited above.

In some embodiments, the new packaging 450 has at least one dimension, i.e., the width WP, the height of the packaging HP, or the depth of the packaging DP, that is less than at least one respective dimension of the main panel 602, i.e., the width of the main panel WMP, the height of the main panel HMP, or the depth of the main panel DMP. In some embodiments, the width of the packaging WP is between about 5% and about 70% of the width of the main panel WMP, or between about 10% and about 60% of the width of the main panel WMP, or between about 15% and about 50% of the width of the main panel WMP. In some embodiments, the width of the packaging WP is less than about 70% of the width of the main panel WMP, or less than about 60% of the width of the main panel WMP, or less than about 50% of the width of the main panel WMP, or less than about 40% of the width of the main panel WMP, or less than about 30% of the width of the main panel WMP, or less than about 20% of the width of the main panel WMP, or less than about 10% of the width of the main panel WMP. In some embodiments, the width of the packaging WP is about 10% of the width of the main panel WMP. In some embodiments, the width of the packaging WP is about 20% of the width of the main panel WMP. In some embodiments, the width of the packaging WP is about 25% of the width of the main panel WMP. In some embodiments, the width of the packaging WP is about 26% of the width of the main panel WMP. While the widths, heights, and depths of the new packaging 450 and the main panel 602 are specifically referred to in the figures, the dimensions may be re-organized, such that the width, height, and/or depth comprise different dimensions than those shown in the Figures.

Still further, in some embodiments, the new packaging 450 has at least one dimension, i.e., the width WP, the height of the packaging HP, or the depth of the packaging DP, that is less than at least one respective dimension of the auxiliary panel 604, 606, i.e., the width of the auxiliary panel WA, the height of the auxiliary panel HA, or the depth of the auxiliary panel DA. In some embodiments, the width of the packaging WP is between about 5% and about 70% of the width of the auxiliary panel WA, or between about 10% and about 60% of the width of the auxiliary panel WA, or between about 15% and about 50% of the width of the auxiliary panel WA. In some embodiments, the width of the packaging WP is less than about 70% of the width of the auxiliary panel WA, or less than about 60% of the width of the auxiliary panel WA, or less than about 50% of the width of the auxiliary panel WA, or less than about 40% of the width of the auxiliary panel WA, or less than about 30% of the width of the auxiliary panel WA, or less than about 20% of the width of the auxiliary panel WA, or less than about 10% of the width of the auxiliary panel WA. In some embodiments, the width of the packaging WP is about 10% of the width of the auxiliary panel WA. In some embodiments, the width of the packaging WP is about 20% of the width of the auxiliary panel WA. In some embodiments, the width of the packaging WP is about 25% of the width of the auxiliary panel WA. In some embodiments, the width of the packaging WP is about 30% of the width of the auxiliary panel WA. While the widths, heights, and depths of the new packaging 450 and the auxiliary panel 604, 606 are specifically referred to in the figures, the dimensions may be re-organized, such that the width, height, and/or depth comprise different dimensions than those shown in the Figures.

In some embodiments, the width of the main panel WMP is between about 10" (25 cm) and about 30" (76 cm), or about 25.5" (65 cm), or at least 20" (51 cm), or at least 25" (64 cm). In some embodiments, the height of the main panel HMP is between about 10" (25 cm) and about 35" (89 cm), or about 29.4" (75 cm), or at least 20" (51 cm), or at least 29" (74 cm). In some embodiments, the width of the auxiliary panel WA is between about 8" (20 cm) and about 30" (76 cm), or about 25.5" (65 cm), or at least 20" (51 cm), or at least 25" (64 cm). In some embodiments, the height of the auxiliary panel HA is between about 8" (20 cm) and about 35" (89 cm), or about 29.1" (74 cm), or at least 20" (51 cm), or at least 29" (74 cm).

By designing a kit including the various disassembled components described herein and the new packaging 450 for retaining those components, a gate assembly 600 that can be set up on site quickly and with relatively simple assembly, with a reduced shipping and storage profile, and with reduced shipping costs is provided.

As noted herein, the gate assembly 100, 600 can be disassembled and assembled together at any time. Therefore, the gate assembly 100, 600 can be assembled and secured in an opening. Then, after the gate assembly 100, 600 fulfills its use, the gate assembly 100, 600 can be disassembled and efficiently stored until the gate assembly 100, 600 needs to be used again. For example, the user may store the gate assembly 100, 600 in a disassembled state until the user's next child, grandchild, or pet will need it. Further, since the gate assembly 100, 600 can be shipped disassembled, shipping costs can be greatly reduced. Furthermore, since the size of the shipping package can be reduced, the gate assembly 100, 600 can have a better impact on the environment while being shipped.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the present disclosure and claims. The entire disclosure of each patent and publication cited herein is incorporated by reference, as if each such patent or publication were individually incorporated by reference herein.

We claim:

1. A gate assembly, comprising:

a support assembly, the support assembly comprising:

a first support including a lower end having a first opening and an upper end having a latch assembly disposed thereon;

a second support including a lower end having a second opening; and a base positioned below the first support and the second support, the base comprising a first flange adjacent a first end of the base and a second flange adjacent a second end of the base, wherein the first flange is positioned within the first support and the second flange is positioned within the second support, and wherein the first flange and the second flange extend upwardly from a side of the base opposite a ground; and a gate, the gate comprising:

an upper rail;

a lower rail; and a plurality of posts disposed orthogonally with respect to the upper rail and the lower rail, wherein the plurality of posts are removably engaged with the upper rail and the lower rail, wherein the gate is rotatably attached to the support assembly, wherein the first opening is configured to receive and completely surround the first flange so that the base is removably attached to the first support, and wherein the second opening is configured to receive and completely surround the second flange so that the base is removably attached to the second support.

2. The gate assembly of claim 1, wherein the first flange and the second flange comprise a U-shaped cross section.

3. The gate assembly of claim 1, wherein at least four of the plurality of posts are removably engaged with the upper rail and the lower rail by a plurality of post fasteners.

4. The gate assembly of claim 1, wherein the first support comprises a first upper spindle assembly and the second support comprises a second upper spindle assembly.

5. The gate assembly of claim 4, wherein the base comprises a first lower spindle assembly secured to the first end of the base and a second lower spindle assembly secured to the second end of the base.

6. The gate assembly of claim 5, wherein the first upper spindle assembly, the second upper spindle assembly, the first lower spindle assembly, and the second lower spindle assembly are configured to secure the gate assembly to a wall of an opening.

7. The gate assembly of claim 1, wherein the first flange comprises a length L4 and the base comprises a length L3, and wherein a ratio between the length L4 and the length L3 is between about 0.08 and about 0.12.

8. The gate assembly of claim 1, wherein a plurality of auxiliary panels are secured to the support assembly.

9. A gate assembly, comprising:

a support assembly, the support assembly comprising:

a first support including a lower end having a first opening and an upper end having a latch assembly disposed thereon;

a second support including a lower end having a second opening; and a base positioned below the first support and the second support, the base comprising a first flange adjacent a first end of the base and a second flange adjacent a second end of the base, wherein the first opening is configured to receive and completely surround the first flange so that the base is removably attached to the first support, and the second opening is configured to receive and completely surround the second flange so that the base is removably attached to the second support, and wherein the first flange and the second flange extend upwardly from a side of the base opposite a ground; and a gate, the gate comprising:

an upper rail;

a lower rail secured with the base; and a plurality of posts disposed orthogonally with respect to the upper rail and the lower rail, wherein the plurality of posts are removably engaged with the upper rail and the lower rail, wherein the gate is rotatably attached to the support assembly.

10. The gate assembly of claim 9, wherein the gate assembly further comprises a plurality of extension assemblies configured to be removably attached with the support assembly, and wherein each of the plurality of extension assemblies add between about 2.5 cm and about 10 cm to a width of the gate assembly.

11. The gate assembly of claim 10, wherein each of the plurality of extension assemblies comprise an upper coupler, a lower coupler, an extension post, an upper extension housing, and a lower extension housing.

12. The gate assembly of claim 11, wherein the extension posts comprise a greater diameter than the plurality of posts.

13. The gate assembly of claim 11, wherein a spindle assembly is positioned within each of the upper and lower couplers.

14. The gate assembly of claim 9, wherein the upper rail of the gate comprises an opening mechanism that is configured to attach with a latch assembly on the first support to lock the gate in place on the support assembly.

15. A kit for a gate assembly, comprising:

a support assembly, the support assembly comprising:

a first support including a lower end having a first opening and an upper end having a latch assembly disposed thereon;

a second support including a lower end having a second opening; and a base positioned below the first support and the second support, the base comprising a first flange adjacent a first end of the base and a second flange adjacent a second end of the base, wherein the first opening is configured to receive and completely surround the first flange so that the base is removably attached to the first support, the second opening is configured to receive and completely surround the second flange so that the base is removably attached to the second support, and wherein the first flange and the second flange extend upwardly from a side of the base opposite a ground;

a gate, the gate comprising:

an upper rail;

a lower rail; and a plurality of posts disposed orthogonally with respect to the upper rail and the lower rail, wherein the plurality of posts are removably engaged with the upper rail and the lower rail; and a plurality of spindle assemblies wherein the gate assembly defines a plurality of gate assembly dimensions, wherein components comprising the support assembly, the gate, and the plurality of spindle assemblies are contained in a package that defines a plurality of packaging dimensions, and wherein at least one of the plurality of packaging dimensions is smaller than at least one of the corresponding gate assembly dimensions.

16. The kit for the gate assembly of claim 15, wherein the kit further includes a plurality of extension assemblies.

17. The kit for the gate assembly of claim 16, wherein the plurality of extension assemblies each add between about 2.5 cm and about 10 cm to a width of the gate assembly.

18. The kit for the gate assembly of claim 15, wherein the first support, the second support, the base, the upper rail, the lower rail, and the plurality of posts are configured to extend substantially parallel to each other in the kit for the gate assembly.

19. The kit for the gate assembly of claim 15, wherein the base comprises a length L3 and the gate comprises a width WF, and wherein the length L3 is larger than the width WF.

20. The kit for the gate assembly of claim 15, wherein the first support comprises a length L1 and the base comprises a length L3, and wherein a ratio between the length L3 and the length L1 is at least 0.9.

* * * * *